United States Patent [19]

Losee

[11] Patent Number: 4,829,310

[45] Date of Patent: May 9, 1989

[54] WIRELESS COMMUNICATION SYSTEM USING CURRENT FORMED UNDERGROUND VERTICAL PLANE POLARIZED ANTENNAS

[75] Inventor: Ferril A. Losee, Provo, Utah

[73] Assignee: Eyring Research Institute, Inc., Provo, Utah

[21] Appl. No.: 393,043

[22] Filed: Jun. 23, 1982

Related U.S. Application Data

[63] Continuation-in-part of Ser. No. 308,080, Oct. 2, 1981.

[51] Int. Cl.[4] ..... H01Q 1/04

[52] U.S. Cl. ..... 343/719; 343/847

[58] Field of Search ..... 343/719, 724, 794, 813, 343/847, 877, 854

[56] References Cited

U.S. PATENT DOCUMENTS

| | | | |
|---|---|---|---|
| 714,246 | 11/1902 | Shoemaker . | |
| 760,463 | 5/1904 | Marconi . | |
| 771,818 | 10/1904 | DeForest . | |
| 795,762 | 7/1905 | Garcia . | |
| 1,101,533 | 6/1914 | De Forest . | |
| 1,123,119 | 12/1914 | DeForest . | |
| 1,220,005 | 3/1917 | Rogers et al. . | |
| 1,303,729 | 5/1919 | Rogers . | |
| 1,303,730 | 5/1919 | Rogers . | |
| 1,315,862 | 9/1919 | Rogers . | |
| 1,316,188 | 9/1919 | Rogers . | |
| 1,322,622 | 11/1919 | Rogers et al. . | |
| 1,349,103 | 8/1920 | Rogers . | |
| 1,349,104 | 8/1920 | Rogers | 343/719 |
| 1,373,612 | 4/1921 | Hanson . | |
| 1,377,129 | 5/1921 | Hahnemann . | |
| 1,387,736 | 8/1921 | Rogers . | |
| 1,395,454 | 11/1921 | Rogers . | |
| 1,424,365 | 8/1922 | Loftin et al. . | |
| 1,429,240 | 9/1922 | Hanson et al. . | |
| 1,510,799 | 10/1924 | Rogers . | |
| 1,530,129 | 3/1925 | Loftin et al. . | |
| 1,894,244 | 1/1933 | Ruble . | |
| 2,161,044 | 6/1939 | Heintz et al. | 173/367 |
| 2,225,668 | 12/1940 | Subkow et al. | 177/352 |
| 2,574,733 | 11/1951 | Ehrlich | 250/33 |
| 2,712,602 | 8/1951 | Hallen | 343/793 |
| 2,834,012 | 5/1958 | Allen | 343/723 |
| 2,842,768 | 7/1958 | Halperin | 343/877 |
| 2,989,621 | 6/1961 | Barton et al. | 250/4 |
| 2,992,325 | 7/1961 | Lehan | 250/3 |
| 2,998,516 | 8/1961 | Lehan et al. | 250/5 |

(List continued on next page.)

FOREIGN PATENT DOCUMENTS

| | | | |
|---|---|---|---|
| 676331 | 12/1963 | Canada | 250/33.53 |

OTHER PUBLICATIONS

The Radio Amateur's Handbook, American Radio Relay League, 1973, Fiftieth Ed., pp. 578–581.

(List continued on next page.)

*Primary Examiner*—Theodore M. Blum

*Attorney, Agent, or Firm*—Workman Nydegger Jensen

[57] ABSTRACT

A wireless communication system and method for employing underground or low profile surface deployed current drivers for inducing ground currents in the earth which define loop antennas for sending and receiving electromagnetic signals propagated through the atmosphere over a wide bandwidth. The system uses a current driver whose impedance is adjusted so that it matches the impedance of a transmitter/receiver connected thereto. The current driver is capacitively coupled to the surrounding ground so that the current driver and the earth effectively function together as a vertical plane polarized antenna which propagates a vertically polarized electromagnetic signal. The system can be operated using either a single current driver or, where increased signal gain is desired, using an array of current drivers that are spaced in parallel. A undirectional vertically polarized signal may be produced by shortening the length of one current driver conductor with respect to the other arm. Unwanted cancellation currents may be substantially eliminated from the region surrounding the current driver by positioning low conductivity materials so as to extend into the flow paths of the cancellation currents.

71 Claims, 11 Drawing Sheets

U.S. PATENT DOCUMENTS

| | | | |
|---|---|---|---|
| 3,183,510 | 5/1965 | Rawls | 343/719 |
| 3,212,093 | 10/1965 | Brueckmann | 343/724 |
| 3,215,937 | 11/1965 | Tanner | 325/28 |
| 3,346,864 | 10/1967 | Harmon | 343/719 |
| 3,400,402 | 9/1968 | Gallagher et al. | 343/723 |
| 3,435,457 | 3/1969 | Brueckmann | 343/719 |
| 3,577,148 | 5/1971 | Holzschuh | 343/821 |
| 3,594,798 | 7/1971 | Leydorf et al. | 343/719 |
| 3,705,407 | 12/1972 | Wickersham | 343/719 |
| 3,775,772 | 11/1973 | Carrell | 343/719 |
| 3,803,616 | 4/1974 | Kopf et al. | 343/719 |
| 3,867,710 | 2/1975 | Busignies | 340/4 |
| 3,967,201 | 6/1976 | Rorden | 325/28 |
| 4,511,898 | 4/1985 | Bush | 343/736 |
| 4,687,445 | 8/1987 | Williams | 343/719 |

OTHER PUBLICATIONS

Secor, H. W., "American's Greatest War Invention: The Rogers Underground Wireless", Electrical Experimenter, (Mar. 1919), pp. 53–60.

Rogers, J. H., "The Rogers Underground Aerial for Amateurs", Electrical Experimenter, (Jun. 1919), pp. 76–78.

Lavrov, G. A., et al., *Prizemnyye i Podzenmnyye Antenny,* [Near Earth and Buried Antennas], Chapter V, pp. 256–297, (1965, U.S.S.R.).

King, Ronald W. P., "The Theory of Linear Antennas with Charts and Tables for Practical Applications", pp. 436, 579–597, (1956).

"Antenna Engineering Handbook", Edited by Henry Jasik, pp. 215–224, (1961).

Guy, A. W. & Hasserjian, G., "Underground Antenna Systems Design Handbook", The Boeing Company, Report No. D2-7760, (Nov. 1961), also known as Design Criteria for Buried Antennas (produced under Minuteman Contract No. AF 04(647)-289).

Hasserjian, G. & Guy, A. W., "Low-Frequency Subsurface Antennas", IEEE Transactions on Antennas and Propagation, pp. 225–232, (May 1963).

Guy, A. W. & Hasserjian, G., "Impedance Properties of Large Subsurface Antenna Arrays", IEEE Transactions on Antennas and Propagation, pp. 232–240, (May 1963).

Wundt, R., "Buried Taveling-Wave Antennas", Applied Research Laboratory, Sylvania Electronic Systems, Research Report No. 394, (Mar. 1964).

Wolff, Edward A., "Antenna Analysis", pp. 241–267, (1966).

Blake, LaMont V., "Antennas", pp. 209–255, (1966).

Christinsin, Alan S., "More on the Long Haul Inverted L Long Wire", (1976).

Christinsin, Alan S., "The AFWONXX Longwire", (1976).

Christinsin, Alan S.; "More on the AFWONXX Sloping Long Wire", (1976).

Christinsin, Alan S., "Theoretical Performance Comparison of Two Tactical Long Wire Type Antennas Over Poor Ground", (1976).

Misek, Victor A., "The Beverage Antenna Handbook", First Edition, (1977).

"Antenna Engineering Handbook, Second Edition", Edited by Richard C. Johnson and Henry Jasik, pp. 11–18, (1961–1984).

Brumeller, Carl G., "Travelling-Wave Antennas", CQ Magazine, p. 32, (Apr. 1984).

Smith, Glenn S., "Annotated Bibliography on Buried Antennas", Georgia Institute of Techology, School of Electrical Engineering, (Feb. 1986), (Produced under Government Contract No. F30602 81-C-0185).

"Notes, Wireless Telegraphy with Invisible Antennae", The Electrician, No. 1,764 at 1, (Mar. 8, 1912, Great Britain).

Kiebitz, F., "Recent Experiments on Directive Wireless Telegraphy with Earth Antennae", *The Electrician,* No. 1,764, at 868–70, (Mar. 8, 1912, Great Britain).

The American Radial Relay League, Inc., The A.R.R.L. Antenna Book, pp. 236–237, (1960).

Blair, W. E., "Experimental Verification of Dipole Radiation in a Conducting Half-Space", *IEEE Transactions on Antennas and Propagation,* at 269–275, (May, 1963).

Chen, C. L. and King, R. W. P., "The Small Bare Loop Antenna Immersed in a Dissipative Medium", *IEEE Transactions on Antennas and Propagation,* at 266–269, (May, 1963).

Hansen, R. C., "Radiation and Reception with Buried and Submerged Antennas", *IEEE Transactions on Antennas and Propagation,* at 207–216, (May, 1963).

King, R. W. P. and Iizuka, K., "The Complete Electromagnetic Field of a Half-Wave Dipole in a Dissipative Medium", *IEEE Transactions on Antennas and Propagation,* at 275–285 (May, 1963).

Iizuka, K., "The Circular Loop Antenna Immersed in a Dissipative Medium", *IEEE Transactions on Antennas and Propagation,* at 43–47, (Jan., 1965).

(List continued on next page.)

OTHER PUBLICATIONS

Galejs, J., 15 *Antennas in Inhomogeneous Media* (1969), p. 71 of Chapter 6; § 9.1 of Chapter 9; § 10.3 of Chapter 10.

Biggs, A. W. and Swarm, H. M. "Radiation Fields of an Inclined Electric Dipole Immersed in a Semi-Infinite Conducting Medium", *IEEE Transactions on Antennas and Propagation,* at 306–310, (May, 1973).

Fenwick, R. C. and Weeks, W. L., "Submerged Antenna Characteristics", *IEEE Transactions on Antennas and Propagation,* at 296–305, (May, 1973).

Lee, K. M. and Smith. G. S., "Measured Properties of Bare and Insulated Antennas in Sand", *IEEE Transactions on Antennas and Propagation,* at 664–667, (Sep. 1975).

Shren, L. C., King, R. W. P. and Sorbello, R. M., "Measured Field of a Directional Antenna Submerged in a Lake", *IEEE Transactions on Antennas and Propagation,* at 891–894, (Nov. 1976).

King, R. W. P. and Sandler, B., "Subsurface Communication Between Dipoles in General Media", *IEEE Transactions on Antennas and Propagation,* at 770–775, (Nov. 1977).

Ancona, C., "On Small Antenna Impedance in Weakly Dissipative Media", *IEEE Transactions on Antennas and Propagation,* at 341–343, (Mar. 1978).

Burrell, G. A. and Peters, L. Jr., "Pulse Propagation in Lossy Media Using the Low-Frequency Window for Video Pulse Radar Application", *Proceedings of the IEEE,* at 981–990, (Jul. 1979).

King, R. W. P., and Sandler, B. H. and Shen, L. C., "A Comprehensive Study of Subsurface Propagation from Horizontal Electric Dipoles", *IEEE Transactions on Geoscience and Remote Sensing,* at 225–233, (Jul. 1980).

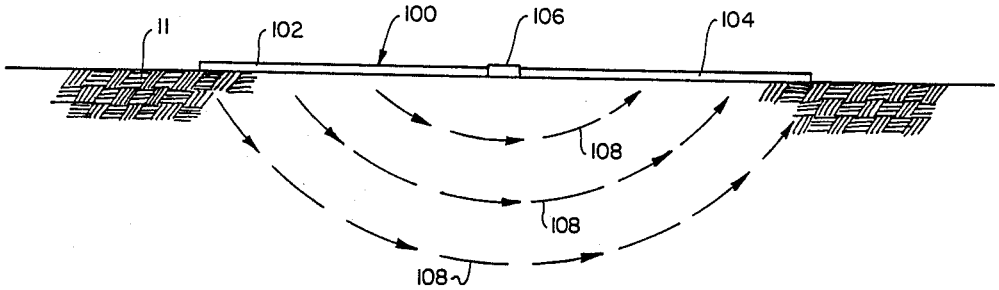
(U) Fig. 1
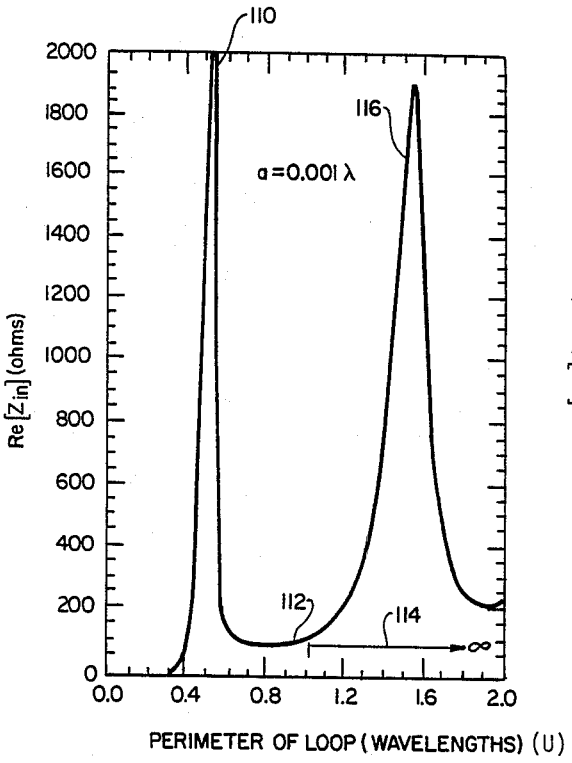
(U) Fig. 2
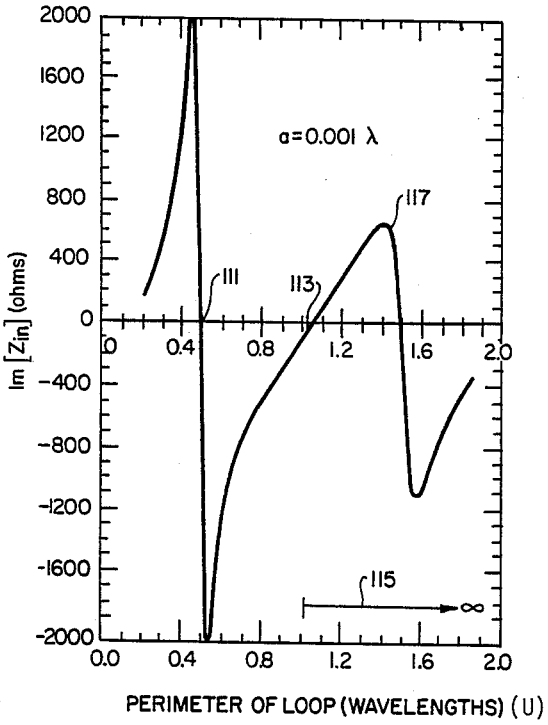
(U) Fig. 3

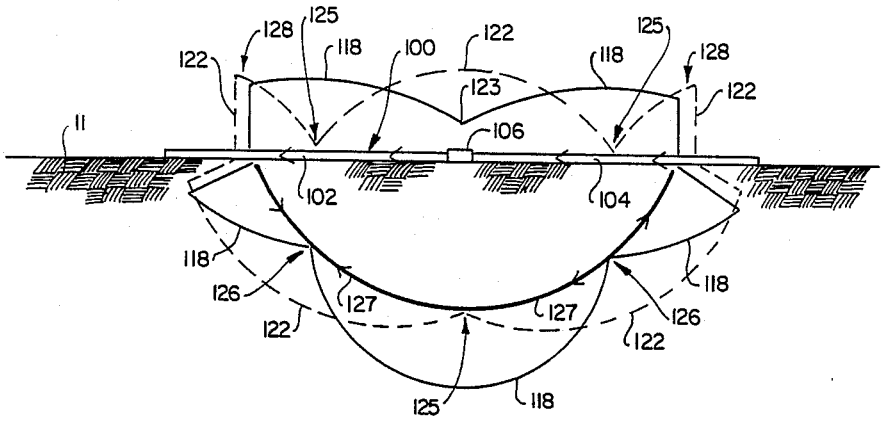
(S) Fig. 4
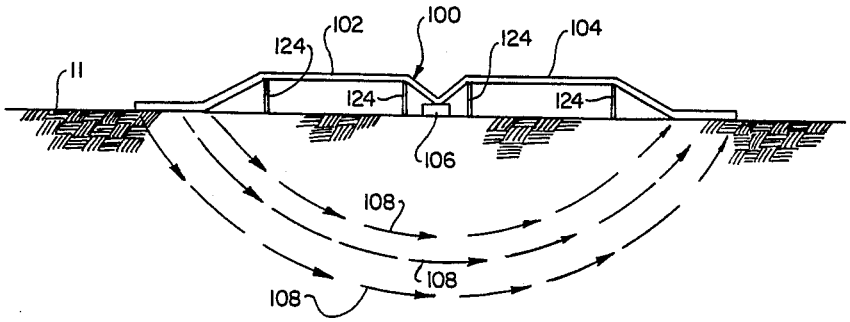
(S) Fig. 5
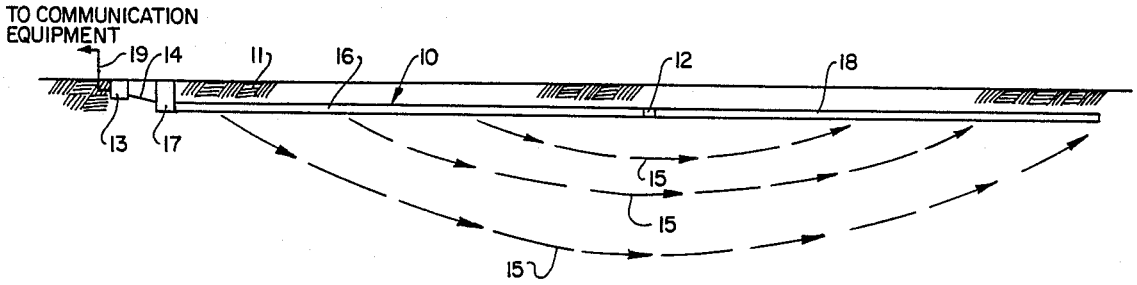
(S) Fig. 6

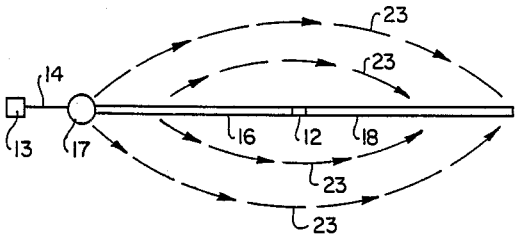
(S) Fig. 7
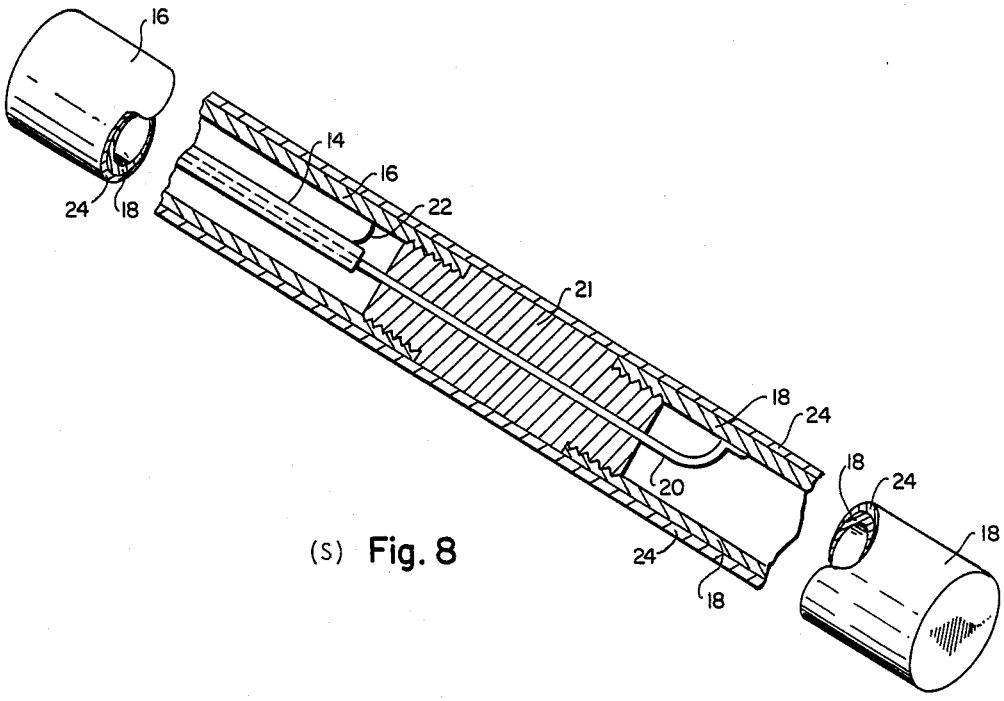
(S) Fig. 8
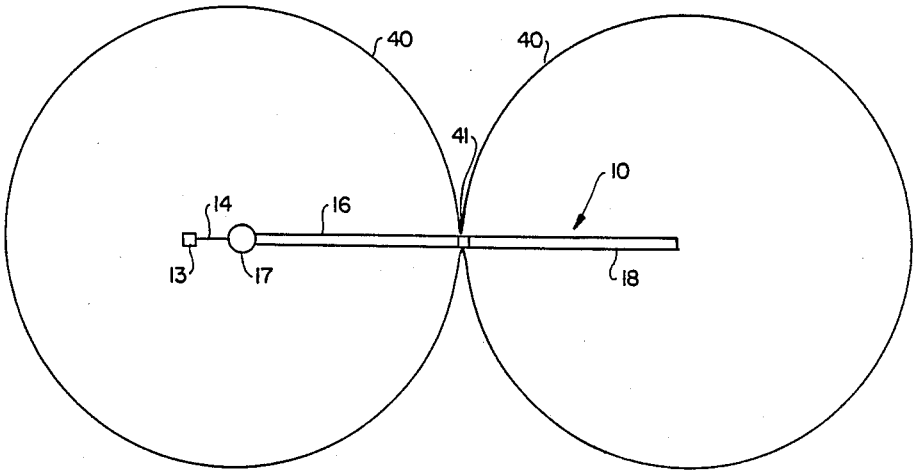
(S) Fig. 9

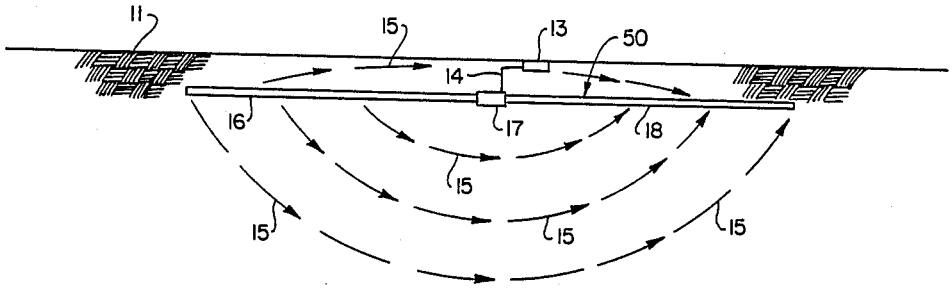
(S) Fig. 10
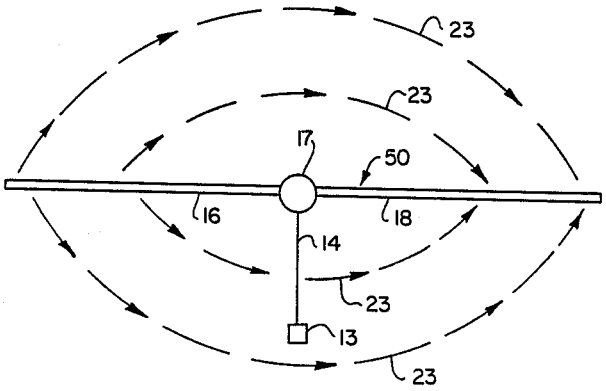
(S) Fig. 11
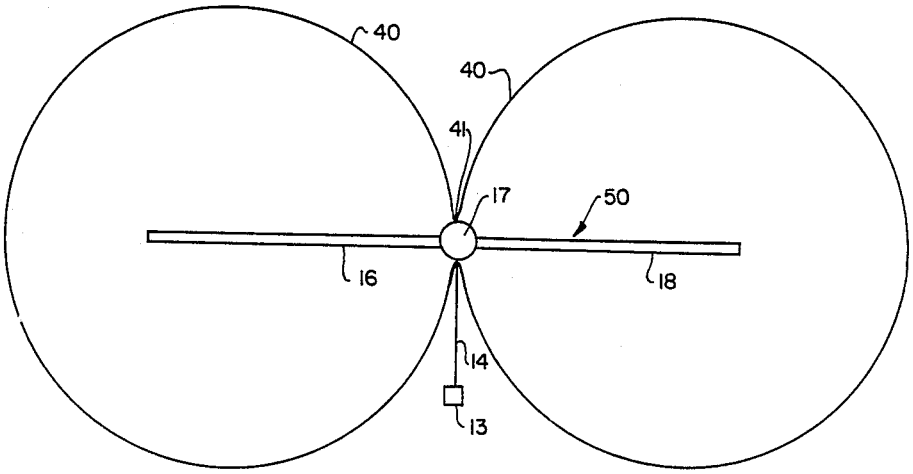
(S) Fig. 12

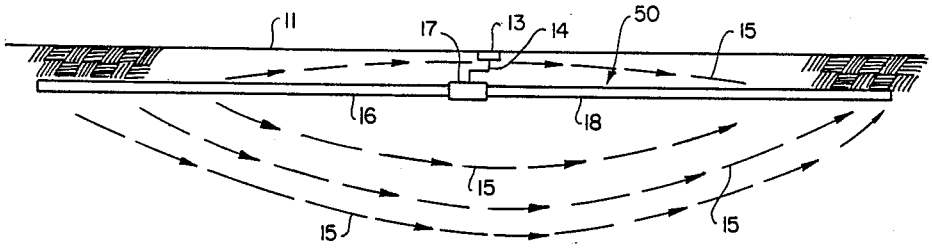
(S) Fig. 13
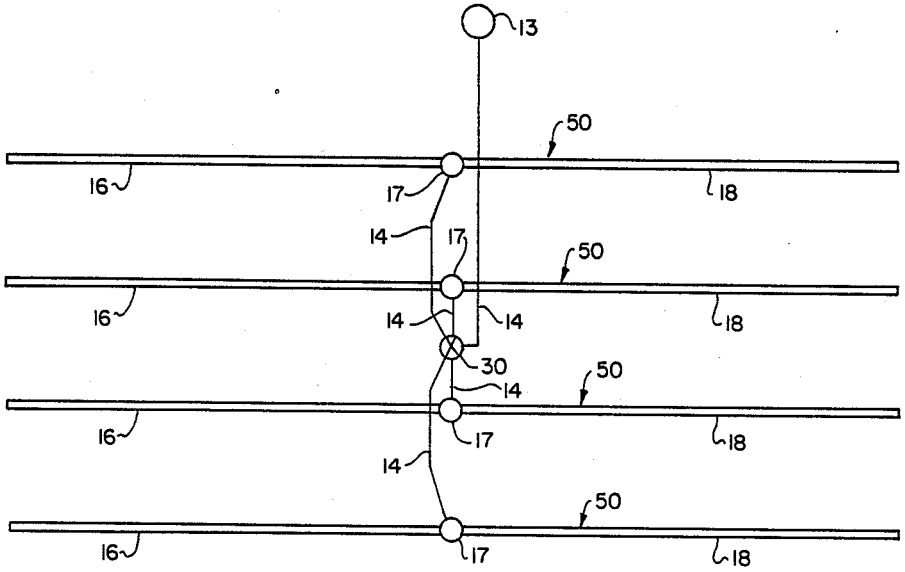
(S) Fig. 14
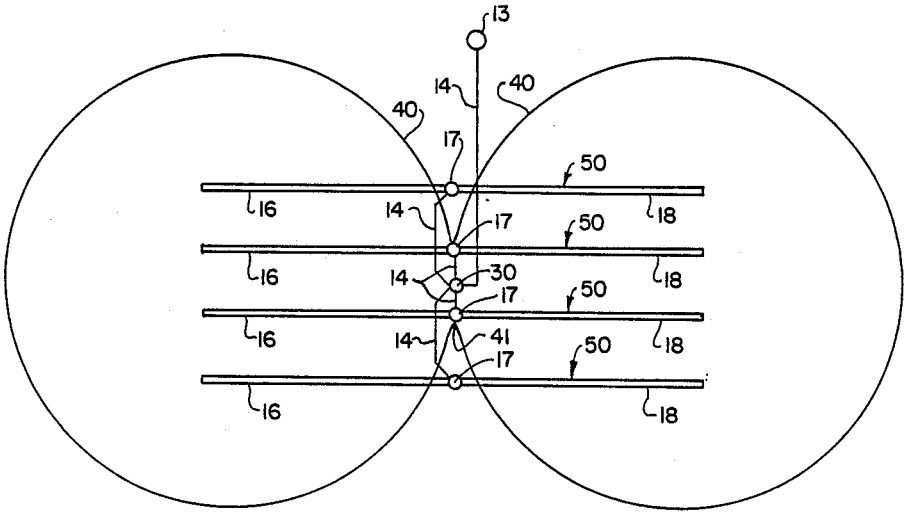
(S) Fig. 15

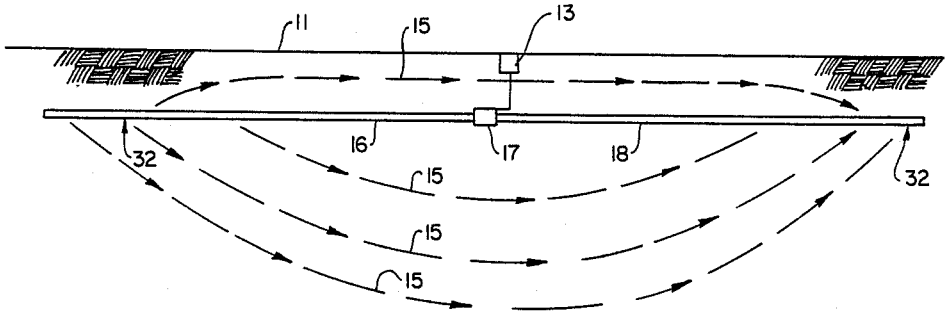
(S) Fig. 16
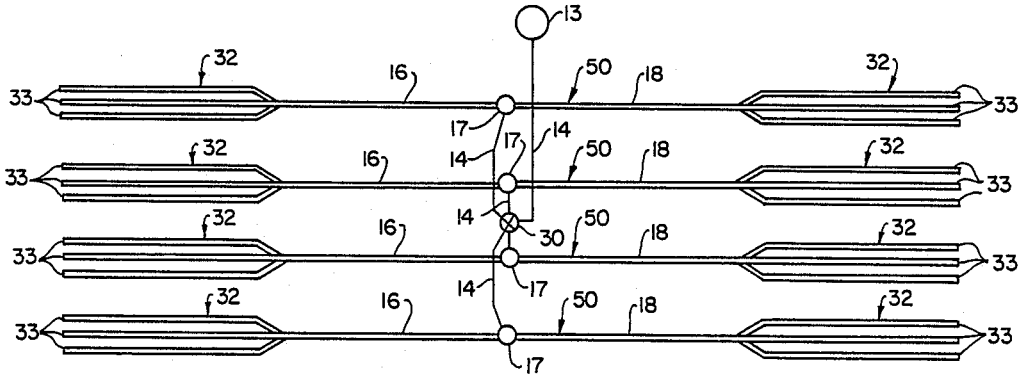
(S) Fig. 17
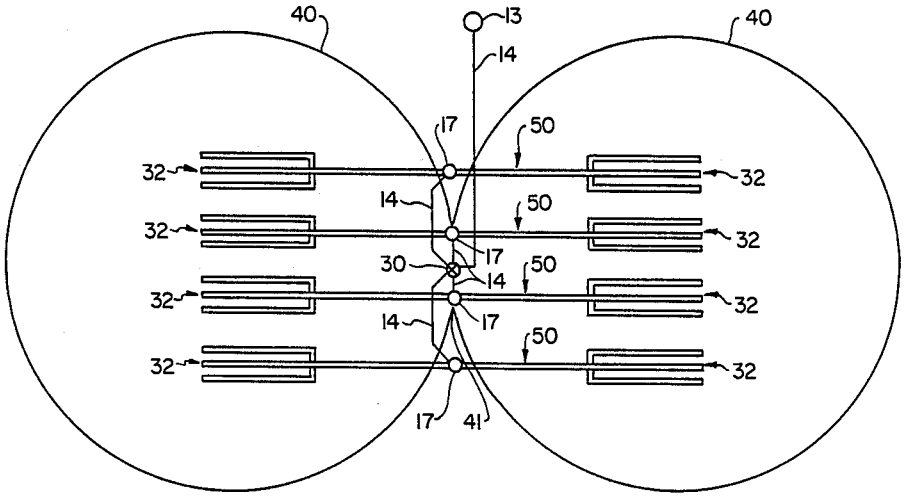
(S) Fig. 18

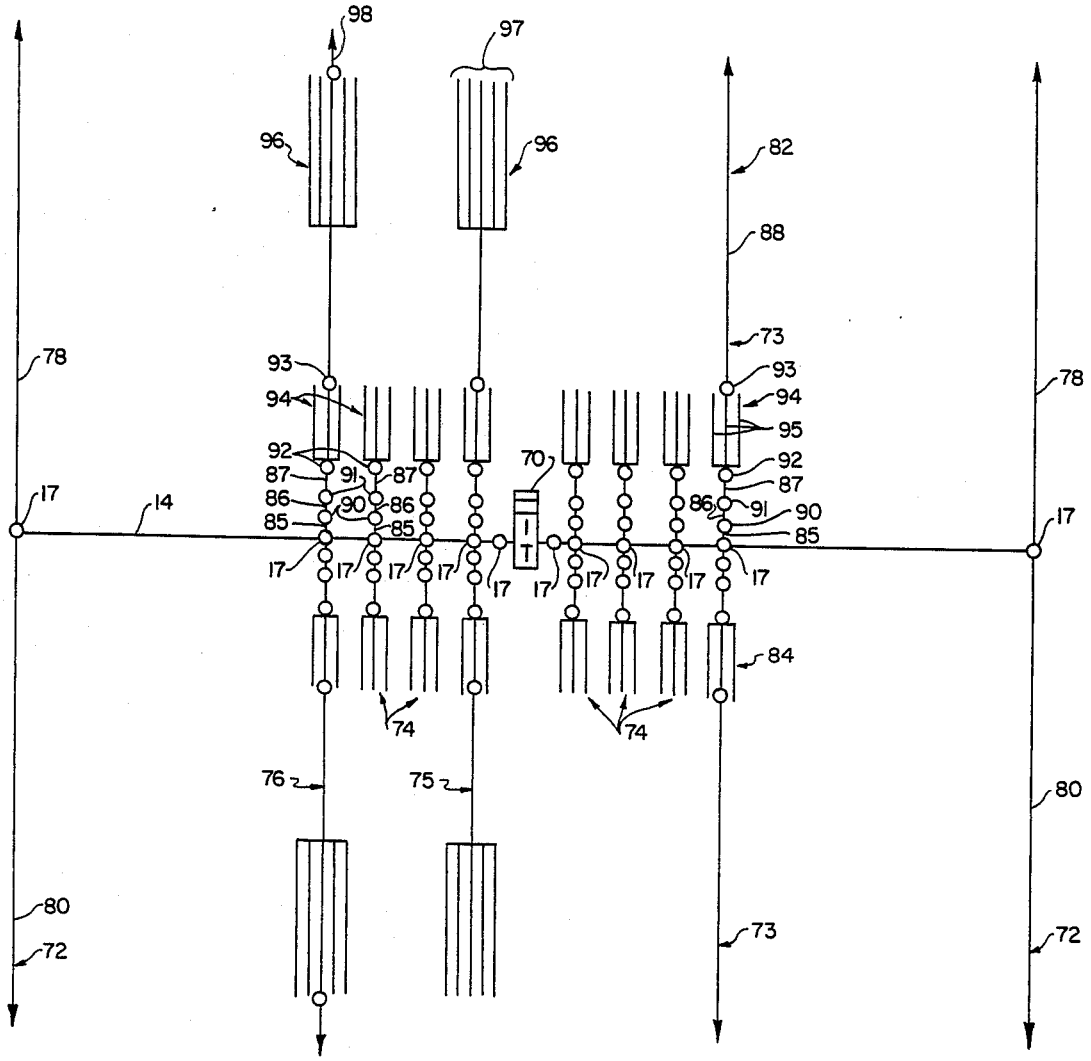
(S) Fig. 19

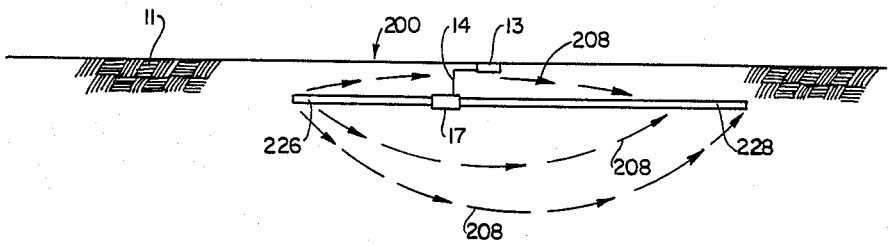
(S) Fig. 20
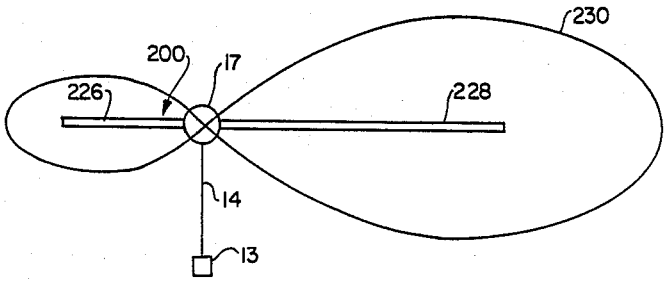
(S) Fig. 21
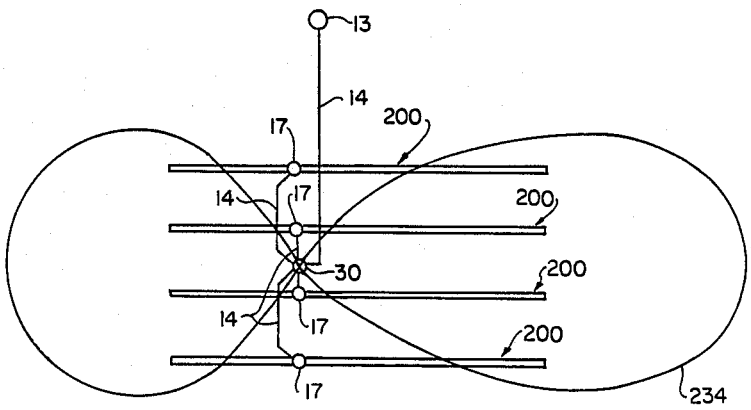
(S) Fig. 22

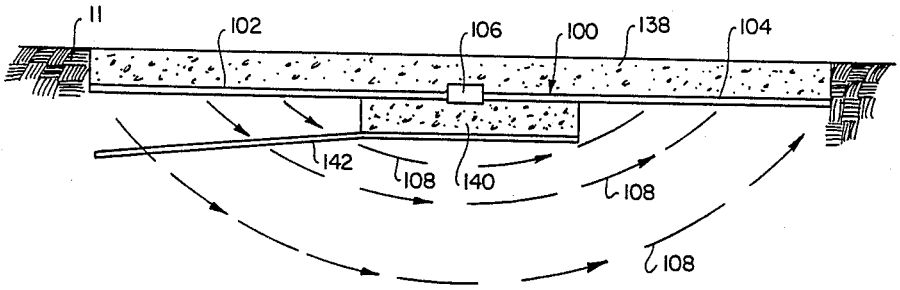
(S) Fig. 23
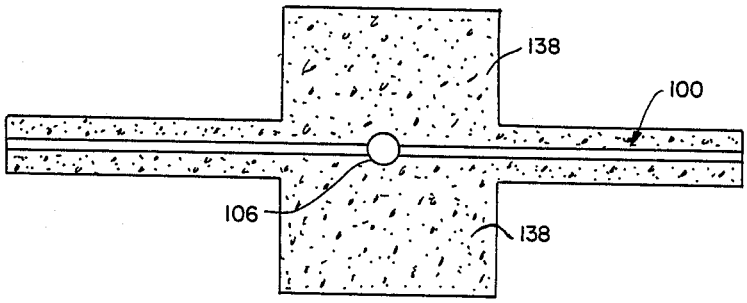
(S) Fig. 24
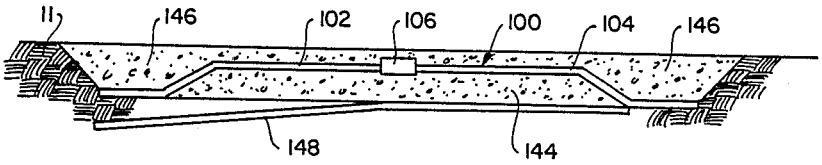
(S) Fig. 25

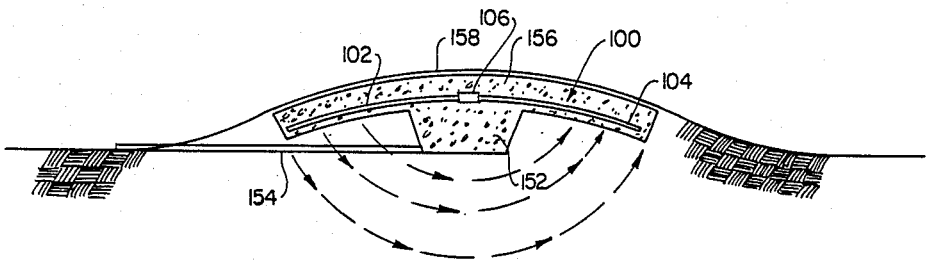
(S) Fig. 26
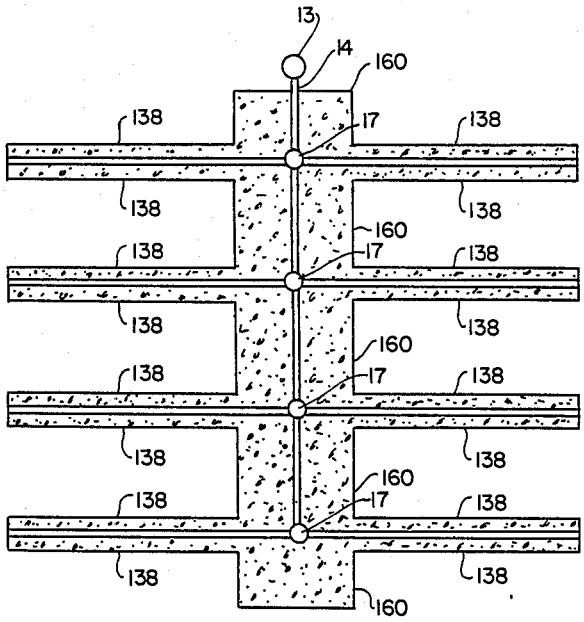
(S) Fig. 27

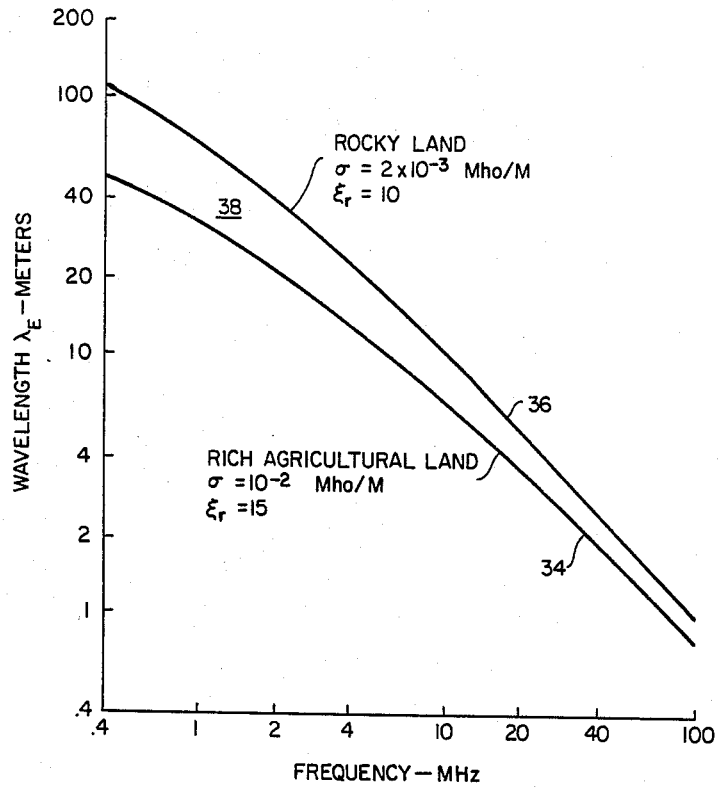
(U) Fig. 28
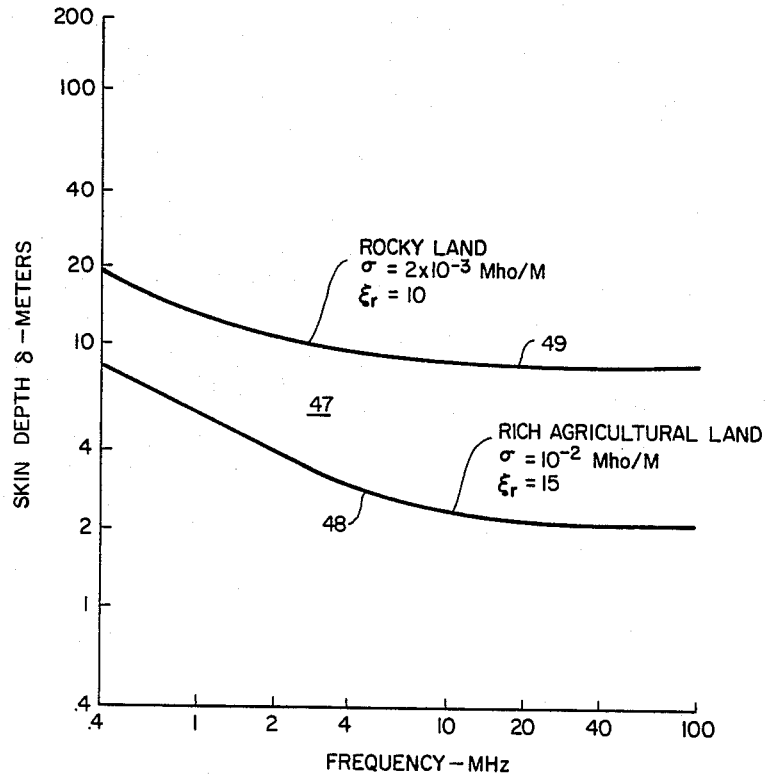
(U) Fig. 29

WIRELESS COMMUNICATION SYSTEM USING CURRENT FORMED UNDERGROUND VERTICAL PLANE POLARIZED ANTENNAS

RELATED APPLICATION

This application is a continuation-in-part of my copending U.S. application Ser. No. 308,080, filed Oct. 2, 1981.

BACKGROUND

1. Field of the Invention

This invention relates to an improved wireless communication system and method, and more particularly to a system and method for employing underground or low profile, surface deployed current drivers for inducing ground currents in the earth in such a way that the current drivers and earth function together as vertical plane polarized antennas which perform as loop or long-wire guided wave antennas and which send and receive vertically polarized electromagnetic signals propagated through the atmosphere over a wide bandwidth.

2. The Prior Art

Aboveground wireless communication systems have been known and used for many years. Generally, such systems employ aboveground antennas which extend high into the air for transmitting and receiving low, medium and high frequency electromagnetic signals which travel through the atmosphere. In a military sense, such aboveground communication systems are considered "soft" for security purposes because they are relatively easy to destroy. "Hardness" (or "softness") is a military term used to denote the system's vulnerability to destruction under attack. The harder a system is, the less vulnerable to destruction it is.

The hardness of a communication system is generally measured by such criteria as its ability to withstand substantial shock, as in the case of a powerful explosion occurring very near to the system and its ability to survive high energy electromagnetic pulse radiation which may be produced by a nuclear blast.

Even though a powerful explosion may be centered some distance from an aboveground communication system, the resulting shock waves will likely damage or destroy the system antennas. Furthermore, aboveground antennas which transmit or receive high frequency signals are very susceptible to the adverse effects of electromagnetic pulse radiation. Even though attempts have been made to increase the hardness of aboveground communication systems by constructing backup systems, factors such as cost and environmental considerations make it very difficult to justify and obtain the redundancy required to make such systems secure in the event of attack.

In order to increase system hardness, it is desirable to deploy communication system antennas under the ground or flat upon the ground, and in some cases it is desirable to deploy at least part of the antennas above but in close proximity to the surface of the ground. Underground and near surface above ground deployed antennas ("low profile antennas") are able to withstand the effects of nearby explosions to a much greater degree than conventional aboveground antennas. Further, such underground and surface proximity antennas are exposed to less electromagnetic pulse radiation. Because of these advantages, a communication system utilizing underground or low profile antennas requires less redundancy to achieve system security than a comparable communication system using typical aboveground antennas. However, although system hardness is improved, prior art undergroundlow profile antenna systems have been substantially less efficient in their operation than the high, aboveground antennas. Because of their poor performance characteristics, such antenna systems have had limited and very specific applications and have been wholly unable to adequately function as a replacement for the high, aboveground antenna systems.

Such inadequate performance characteristics are embodied in the various wireless subterranean signaling systems which have been proposed in the past, wherein electromagnetic signals are transmitted through the earth between underground antennas. For example, electromagnetic waves of relatively low frequencies ranging from 100 Hz to 100 KHz have been propagated through the earth between horizontally polarized electric dipole antennas buried in the earth. Such underground transmission of signals is inherently susceptible to significant signal attenuation due to the large dielectric coefficient and high conductivity of the earth. This is due to the fact that in a conductive (i.e., lossy) medium such as the earth or water, energy is dissipated through currents that are generated by the electric and magnetic field components of the wave. This energy loss results in an appreciable exponential attenuation of field strength with distance. In contrast, electromagnetic waves propagated through the atmosphere lose little energy to the medium. Thus, excess attenuation beyond inverse $R^2$ loss is negligible in the atmospheric case except at microwave and higher frequencies.

In order to achieve system hardness while utilizing the atmosphere for signal transmission, several past proposals have involved the positioning of a dipole antenna upon or beneath the surface of the earth. Such systems have experienced significant reduction in signal strength as compared with aboveground, vertically oriented dipole antennas as a result of signal attenuation and losses in the earth.

Comparisons of the performance of subsurface dipole antennas to conventional above surface antennas are presented in Fenwick and Weeks, *Submerged Antenna Characteristics,* I.E.E.E. TRANSACTIONS ON ANTENNAS AND PROPAGATION, p. 296 (May, 1963), where it is seen that in many common situations the strength of the underground produced signal is more than 40 dB weaker than the signal produced by the reference antenna, which is a perfect quarter-wave vertical monopole antenna. Such reduced signal power is simply not acceptable for many communications systems applications, especially when such applications may involve long-range signal transmission. In addition to the above problem, dipole antennas produce electromagnetic signals which propagate in directions generally normal to the longitudinal axis of the dipole antenna. As a result, much of the signal strength is directed substantially straight upwards or into the ground where it is lost, resulting in significant amounts of power loss and reduced efficiency in the communication system.

In order to provide an underground antenna system while transmitting usable signals through the atmosphere, it has been proposed in the prior art to employ a buried loop antenna for generating a horizontally polarized magnetic wave which in turn generates a surface wave having a vertically polarized electric component to be received by a vertical whip receiving antenna. Although a substantial portion of the resulting signal propagates along the earth's surface, this antenna system still is very low in efficiency which is mainly a result of the use of horizontally polarized waves and the losses associated therewith. Another disadvantage of this type of prior art antenna is the very large physical antenna size needed at low and even medium range frequencies.

It becomes clear that the most efficient means for obtaining system hardness while providing for transmission and reception of electromagnetic signals through the atmosphere would be to utilize a buried wire loop or traveling wave antenna which could produce vertical plane polarized electromagnetic signals. However, it is well known that the size of such an antenna is directly related to the wavelength of the signal in earth at the frequency of operation. In fact, for optimal operation the perimeter length of the underground loop antenna should be approximately 1.4 wavelengths in earth at the operating frequency. For an operating frequency in the MF range of 400 KHz, the necessary loop antenna perimeter length would be approximately 100 meters. It becomes immediately apparent that, even if physically possible, the cost of trenching, supporting and burying such an antenna in the vertical position would make use of the antenna unrealistic if not impossible.

A further problem that is common to all underground antennas is the lower power gain which is experienced as a result of signal attenuation prior to signal entry into the atmosphere. Although this attenuation can be minimized by positioning the antenna close to the surface, it still exists in significant amounts. No adequate method has heretofore been found for substantially increasing the gain of atmospheric transmission signals emanating from an underground source and thus, this reduced performance capability has continued to be a long-standing, unresolved problem in the art.

In light of the above considerations, it is apparent that the great need that has heretofore gone unsatisfied is to provide a two-way, wireless underground or near surface aboveground deployed communication system capable of effectively receiving and transmitting signals over a wide band of frequencies, with the system being sufficiently "hard" to withstand a near miss of a nuclear weapon. The system should have reduced vulnerability to jamming and, even immediately following a nuclear explosion, should permit long distance transmission of electromagnetic signals with reasonable data rates. The system should be capable of transmitting communication signals in either broad or narrow beam configurations, and in conjunction with enhanced signal processing, should be capable of performance comparable to existing aboveground antenna systems. Furthermore, the system should feasibly permit redundancy sufficient to satisfy the need for system security without excessive costs. The underground communication systems heretofore employed have not been able to satisfy these important needs.

BRIEF SUMMARY AND OBJECTS OF THE INVENTION

The present invention advantageously provides a unique two-way, wireless communication system and method that employs an underground or surface or low profile current driver arrangement for sending and receiving electromagnetic signals propagated through the atmosphere. The system is operable on a wide frequency band, and produces steerable signals having a power gain and data rates comparable to signals transmitted from more conventional aboveground systems.

The present invention involves use of at least one current driver comprising a pair of conductors and a balun positioned flat upon the earth's surface, or positioned above but in proximity to the earth's surface or buried beneath the surface of the ground in proximity to the earth's surface. The elements of the current driver are constructed so that it is capacitively coupled with the surrounding earth in a manner such that induced ground currents cause the current driver and the earth to effectively function together as a vertical plane polarized loop antenna. A vertically polarized signal is transmitted from this antenna into the atmosphere where it continues to propagate as a vertically polarized wave.

In one preferred embodiment, the two current driver conducting arms are positioned end-to-end and joined at the middle to a balance-to-unbalance ("balun") impedance matching transformer. When the current driver is thus configured, with the impedance of the current driver and earth substantially matched or correlated to that of a transmitter/receiver connected thereto, the capacitively coupled current causes the current driver and the earth to effectively function as a vertical plane loop antenna which produces a bidirectional vertically polarized electromagnetic signal.

In another preferred embodiment, the length of one of the two current driver conducting arms is substantially shorter than the other conducting arm. A length ratio for the arms of approximately 2 to 1 has been found to be adequate for many applications while larger ratios provide further improvement in antenna gain. In this configuration, the capacitively coupled current causes the current driver and the earth to effectively function as a long-wire traveling wave antenna which produces a substantially unidirectional vertically polarized electromagnetic signal. For a length ratio of 2 to 1 the power gain is approximately 4 dB greater than the above-described bidirectional signal.

Power gain in each of the embodiments is further improved by positioning several current drivers parallel to one another and at spacings which may be as close as half a skin depth in ground. These are fed in parallel using a power splitter and appropriate lengths of line.

Conducting tree elements may be affixed to the ends of the current driver conducting arms to move the capacitive coupling further out toward the ends of the arms, thus reducing by as much as one-third the current driver length required to receive or transmit at a given frequency. The communication system described herein may be used in a surface deployed mode (i.e., flat on the ground) in an aboveground, low profile mode, or it may be buried under the earth near the earth air interface.

Further operating efficiency is achieved in the underground deployed system by placing porous, low conductivity material adjacent the entire upper portion of the current driver, outward from the central portion of its sides and below its central portion. By this means, the flow of unwanted cancellation currents above and along side the current driver are partially prevented, as is the induction of undesirable ground currents close to the current driver's center. Addition of a drainage means below the low conductivity material and optional placement of water resistant material above the current driver prevent pooling of water around the current driver and permit all weather operation.

Accordingly, it is a primary object of the present invention to provide a communication system and method which permits high quality, two-way communication while having the capability of surviving all but a direct hit by a nuclear weapon.

It is another object of the present invention to provide for high quality, long distance atmospheric transmission of communication signals between underground or aboveground, low profile sending and receiving terminals.

It is still another object of the present invention to provide a communication system having underground or aboveground, low profile sending and receiving terminals capable of sending and receiving signals on a wide frequency band at data rates which are comparable to aboveground communication systems.

It is a further object of the present invention to provide a communication system having underground or aboveground, low profile sending and receiving terminals which are configured so as to significantly reduce the current driver length required to transmit and receive at specified frequencies.

Another object of the present invention is to provide an underground or aboveground, low profile communication system which may be configured to produce either bidirectional or unidirectional vertically polarized electromagnetic signals and which may be operated in substantially all weather conditions without significant degradation of signal quality.

It is still another object of the present invention to provide a communication system which has a low susceptibility to jamming or to interfering electromagnetic pulse radiation.

Still a further object of the present invention is to provide a long distance communication system using an underground or aboveground, surface proximity deployed current driver arrangement which makes redundancy for purposes of system security economically feasible.

It is still another object of the present invention to provide a communication system which permits initial construction at low cost and which has a very low maintenance cost, thus making the system highly desirable in both military and commercial broadcasting and receiving systems.

Another valuable object of the present invention is to provide a high power, long distance, underground or aboveground, surface proximity deployed communication system which does not degrade the surrounding environment, and which is easily camouflaged.

These and other objects and features of the present invention will become more fully apparent from the following description and appended claims taken in conjunction with the accompanying drawings.

BRIEF DESCRIPTION OF THE DRAWINGS

FIG. 1 is a schematic illustration of a ground surface deployed current driver which embodies the principles of the present invention.

FIG. 2 is a graph which represents the input resistance of a wire loop antenna as a function of the length of the loop antenna perimeter in wavelengths when the loop antenna is located in air.

FIG. 3 is a graph which represents the input reactance of a wire loop antenna as a function of the length of the loop antenna perimeter in wavelengths when the loop antenna is located in air.

FIG. 4 is a schematic illustration of the current driver of FIG. 1 with current and voltage magnitudes represented next to the current paths for the case when the loop is approximately 1.4 wavelengths.

FIG. 5 is a schematic illustration of a low profile deployed current driver which embodies the principles of the present invention.

FIG. 6 is a schematic illustration of an end-fed current driver which embodies the principles of the present invention.

FIG. 7 is a top plan view of the end-fed current driver of FIG. 6.

FIG. 8 is a partial cross-sectional view of the middle portion of the end-fed current driver of FIG. 6.

FIG. 9 is a top plan view of the end-fed current driver of FIG. 7, with the resulting electromagnetic signal wave pattern superimposed thereon.

FIG. 10 is a schematic representation of a center-fed current driver embodying the principles of the present invention.

FIG. 11 is a top plan view of the center-fed current driver of FIG. 10.

FIG. 12 is a top plan view of the center-fed current driver of FIG. 10, with the resulting electromagnetic signal wave pattern superimposed thereon.

FIG. 13 is a schematic representation of another preferred embodiment of the present invention comprising a current driver array having several center-fed current drivers positioned in parallel.

FIG. 14 is a top plan view of the current driver array of FIG. 13.

FIG. 15 is a top plan view of the current driver array of FIG. 13 with the resulting electromagnetic signal wave pattern superimposed thereon.

FIG. 16 is a schematic representation of another preferred embodiment of the present invention comprising a center-fed current driver array, with extensions of the parallel current drivers configured as conductive tree terminations.

FIG. 17 is a top plan view of the center-fed current driver array of FIG. 16.

FIG. 18 is a top plan view of a center-fed current driver array such as that of FIG. 16, with the resulting electromagnetic signal wave pattern superimposed thereon.

FIG. 19 is a top plan view of another embodiment of the present invention, comprising a switched current driver array capable of transmitting signals over a relatively wide band of frequencies.

FIG. 20 is a schematic representation of another preferred embodiment of the present invention comprising a unidirectional current driver embodying the principles of the present invention.

FIG. 21 is a top plan view of the unidirectional current driver of FIG. 20, with the resulting electromagnetic signal wave pattern superimposed thereon.

FIG. 22 is a top plan view of a unidirectional current driver array, with the resulting electromagnetic signal wave pattern superimposed thereon.

FIG. 23 is a schematic illustration of one preferred embodiment of a center-fed current driver in combination with a cancellation current barrier embodying the principles of the present invention.

FIG. 24 is a top plan view of the center-fed current driver and cancellation barrier of FIG. 23.

FIG. 25 is a schematic illustration of another preferred embodiment of a center-fed current driver in combination with a cancellation current barrier embodying the principles of the present invention.

FIG. 26 is a schematic illustration of still another preferred embodiment of a center-fed current driver in combination with a cancellation current barrier embodying the principles of the present invention.

FIG. 27 is a top plan view of a center-fed current driver array in combination with a cancellation current barrier embodying the principles of the present invention.

FIG. 28 is a graph which represents the signal wavelength in the earth as a function of frequency.

FIG. 29 is a graph which represents the signal penetration or skin depth in the earth as a function of frequency.

DETAILED DESCRIPTION OF THE PREFERRED EMBODIMENTS

Reference is now made to the drawings wherein like parts are designated with like numerals throughout.

1. General Discussion

The communication system of the present invention may be generally described by reference to FIGS. 1 through 5. With particular reference to FIG. 1, it is seen that a current driver (generally designated at 100) is positioned in proximity to the earth's surface 11. Current driver 100 is configured similarly to a dipole antenna, in that it has first and second conductors referred to hereinafter as conducting arms 102 and 104 respectively, positioned in end-to-end relationship but separated from electrical contact. Conducting arms 102 and 104 are protected about substantially their entire exterior surface by a sheath of electrical insulating material such as teflon or one of many other commercially available electrical insulators. By this means direct electrical contact with the earth 11 is prevented, while capacitive coupling of the current driver 100 to the earth 11 is encouraged.

The adjacent ends of conducting arms 102 and 104 are connected to a balun 106 that provides impedance matching as well as balance-to-unbalance transformer action in a manner to be described more fully hereinafter. The balun 106 preferably should be capable of approximately matching all impedance values of the current driver 100 and the earth 11 which may exist beyond one loop wavelength at the operating frequency to the impedance of a signal source (not shown) which is connected to balun 106.

When the impedance of the current driver 100 and earth 11 are approximately matched by use of balun 106 to the impedance of a signal source (not shown), ground currents 108 are induced into the surrounding earth 11 through current driver 100. If the length of conducting arms 102 and 104 is sufficiently long, ground currents 108 will define a loop whose perimeter is of a size sufficient to cause the earth 11 and current driver 100 to essentially function together as a vertical plane polarized antenna. The physical means by which this is accomplished may best be described by reference to FIGS. 2 through 4.

FIG. 2 illustrates the input resistance of a square wire loop antenna in air as a function of the loop perimeter, while FIG. 3 illustrates the input reactance of such an antenna. The peak values of resistance and reactance are reduced when the antenna is near or below the earth's surface. Peak resistance in this case would be about 500 ohms. Dipole radiators are generally half wave in length at a given operating frequency, and are operated at a frequency close to the point where the reactance is near zero ohms. This point is illustrated at location 112 in FIG. 2 and at 113 in FIG. 3. In this situation, a center-fed dipole antenna will have maximum currents and minimum voltage levels at the center feed point, and minimum current with maximum voltage levels at the ends of the conducting arms. Maximum signal radiation will thus occur outwardly in a direction substantially normal to the central axis of the dipole antenna.

In contrast, the current driver 100 of the present system is operated in the region above one wavelength loop perimeter where the resistance and reactance are high. This is is essentially opposite to the above-described operating conditions for a typical dipole antenna. In this case, the impedance of the current driver 100 and the earth is approximately matched to that of the signal source (normally a transmitter/receiver), by means of the balun and impedance transformer 106. The current driver 100 is configured so as to have an overall length which is sufficient to induce ground currents into the earth 11 by means of capacitive coupling so as to form a current loop having a perimeter which is in excess of one wavelength in the ground at the system operating frequency. The current driver operating range in which this result can be accomplished includes substantially all conditions where the wavelength is greater than one, as is partially illustrated at 114 in FIG. 2 and at 115 in FIG. 3. The point at which peak operation of the current driver 100 as a loop is approached is illustrated at 116 in FIG. 2 and at 117 in FIG. 3. This position defines a current loop perimeter which is about 1.4 wavelengths of the operating frequency in the earth. The system also approaches peak operating conditions at just less than the half wavelength point between each additional full wavelength (i.e. 2.5, 3.5, 4.5 et. seq.). When the length of the current driver 100 exceeds about one wavelength, the antenna formed by the current driver 100 and the earth begins to operate as a long-wire guided wave antenna with greatly increased antenna gain.

The particular voltage and current waveforms which are present when current driver 100 is operated at operating point 116 can be described by reference to FIG. 4. In this operating condition, the primary current path induced by current driver 100 is illustrated at 127. The current standing wave is indicated at 118. Likewise, the voltage field produced when current driver 100 is fed at point 106 is illustrated at 122. In this operating configuration it can be seen that voltage minimums occur near the positions identified at 125. The voltage on antenna element 100 causes a resulting ground current to be induced in the earth by means of capacitive coupling; the resulting current forming a loop 127 which extends into the earth 11 with its ends coupled to the current driver 100 in the vicinity of 128. The current in loop 127 additionally travels along the body of current driver 100 in the direction illustrated by the arrows in FIG. 4, so as to form a vertical plane loop.

It should be noted that the position along current driver 100 of the current maximum and voltage minimum 125 varies in response to variation of frequency, being at the center for one wavelength loop perimeter and moving outward toward the ends as the frequency increases. Thus, for proper operation the current driver 100 should be of sufficient length to permit capacitive coupling in the preferential coupled region of the driver 100.

When the current driver 100 is long compared to a wavelength there is a substantial increase in antenna gain due to the current driver and earth acting as a long-wire guided wave antenna. Thus, there is a low peak response when the loop perimeter is about 1.4 wavelengths, followed by a partial null when the loop perimeter is about two wavelengths. This is then followed by a substantial increase in antenna gain as the antenna begins to operate as a long-wire guided wave antenna. The performance typically continues to increase with increasing frequency until a maximum is reached in the 15 to 20 MHz range. The gain then slowly drops off with increasing frequency because antenna losses increase faster than directional gain.

Examples of conventional aboveground long-wire guided wave antennas are set forth in chapter 5 of *Antenna Theory and Design,* (pages 239–244) by Warren L. Stutzman and Gary A. Thiele (John Wiley and Sons 1981).

The current and voltage relationships described above remain substantially the same for given earth conditions, and for current drivers of a given length, no matter whether the current driver is positioned upon the surface of the earth as illustrated in FIG. 4, or whether it is positioned so as to have a portion of its length in proximity to but above the surface of the earth as illustrated in FIG. 5, or whether it is buried beneath the surface of the earth close to the interface as will be described more fully hereinafter.

By reference to FIG. 5 one low profile embodiment of the current driver 100 is illustrated. In this embodiment balun 106 is positioned on or near the surface of the earth 11, with the inner portions of insulated conducting arms 102 and 104 being supported above the surface of the earth by means of nonconducting or low conducting posts or stakes 124. The outer portions of conducting arms 102 and 104 are positioned upon the surface of the earth 11. In this manner, capacitive coupling between current driver 100 and earth 11 only occurs along those portions of conducting arms 102 and 104 which are positioned upon the earth itself. Thus, in the configuration of FIG. 5, ground currents are induced into the earth so as to form current loops 108 which extend only between the outer portions of conducting arms 102 and 104. By this means, interior currents which normally travel between the inner portions of arms 102 and 104, and which can cause losses are eliminated. Thus, a more clearly defined vertical plane polarized antenna is defined by the currents 108 and current driver 100.

Particular examples of several preferred embodiments of the underground configuration of the current driver 100 are more fully described hereinafter. Examples of low profile configurations of current drivers which embody the principles of the present invention are outlined in my copending application entitled "LOW PROFILE WIRELESS COMMUNICATION SYSTEM AND METHOD", Ser. No. 308,080, filed on Oct. 2, 1982, which is incorporated by reference herein.

2. The End-Fed Current Driver (FIGS. 6 through 9)

One preferred embodiment of a communication system configuration of the present invention is illustrated in FIGS. 6 through 9. With reference to FIGS. 6 and 7, a current driver (generally designated at 10) is illustrated as being generally configured as a dipole. The current driver 10 may be constructed using insulated cables or insulated pipes.

As shown in FIG. 6, the current driver 10 is buried below the earth's surface 11. The depth of burial is typically between zero and ten meters. For example, the required hardness for withstanding a near miss in many applications would require a burial depth of about one meter. The method of burial may be by conventional trenching and refilling where the ground is soft (i.e., sand, gravel or the like) or by conventional rotary drilling where the ground is rocky or hard. When using trenching as the method of burial, it is typical to use wires or cables for the current driver elements. When using rotary drilling, it is typical to use pipe for the current driver elements. In either case, the current driver 10 is buried substantially parallel to the surface of the earth 11.

Approximately at its mid point 12 current driver 10 is provided with a dielectric partition 21 (see FIG. 8). As shown best in FIG. 8, the dielectric partition 21 is threadingly connected between the pipes 16 and 18 which define the upper and lower conducting arms of current driver 10, respectively. With further reference to FIG. 8 a coaxial cable 14 extends through the center of current driver 10. The inner conductor 20 of coaxial cable 14 extends through the dielectric partition 21 and is secured to the lower conducting arm defined by pipe 18. The outer conductor 22 of coaxial cable 14 is secured to the upper conducting arm defined by pipe 16.

Coaxial cable 14 is connected at its upper end to an impedance matching circuit 17 (see FIGS. 6 and 7) that is used to adjust impedances so as to approximately match or correlate the impedance of the current driver 10 and the earth to the impedance of transmitter/-receiver 13. The impedance matching circuit 25 may be, for example, a transmission line transformer balun that provides impedance matching as well as balance-to-unbalance transformer action, as described in the text *Solid State Radio Engineering,* (pages 371 to 379) by Herbert L. Krauss, Charles W. Bostian and Frederick H. Raab (John Wiley and Sons 1980). As hereinafter more fully explained, this impedance matching technique greatly improves the performance of the communication system.

Impedance matching circuit 25 is connected through cable 14 to the tramsmitter/receiver 13, which comprises a conventional transmitter for sending electromagnetic signals and a conventional receiver for processing received electromagnetic signals. Transmitter/-receiver 13 may be positioned below the surface of the ground 11 and adjacent to one end of the antenna current driver 10, and it may be interconnected with other communication equipment (not shown) located on the surface of the ground 11 by means of cables 19.

An alternative configuration uses a standard 50 ohm coax line 14 which passes through the upper conductor 16 and is connected to a small transmission line transformer balun 17 located in the dielectric section 21. This balun in turn connects to upper and lower conductors 16 and 18 and provides the necessary unbalance-to-balance line transformation and the necessary impedance transformation to match the impedance of the current driver and earth to the coax line. This avoids the need for high impedance coax as would be required in the configuration of FIG. 8.

In one presently preferred embodiment the conducting pipes or arms 16 and 18 and the dielectric partition 21 of current driver 10 are protected by an external sheath of electrical insulating material 24 (see FIG. 8). Sheath 24 prevents short circuiting of the current driver by water that may collect in the bore hole or trench, and it helps to prevent corrosion. In addition, sheath 24 encourages capacitive coupling of the current driver 10 to the surrounding ground during system operation.

Sheath 24 may consist of preformed tapes or sheets of electrical insulating material wrapped about the surface of current driver 10. Alternatively, sheath 24 may be formed by immersing current driver 10 in a liquid bath of electrical insulating material, removing it and then permitting it to dry. Other methods are also known and used for providing such protection.

Although current driver 10 appears to be physically constructed as a dipole antenna, when the impedance of the current driver 10 and earth is approximately matched to the impedance of the transmitter/receiver 13, and when arms 16 and 18 are of a length sufficient to induce a current loop in the earth so that the current loop has a perimeter which is greater in length than one wavelength of the electromagnetic signals in earth, then current driver 10 does not act as a dipole antenna. Under these conditions, the interaction between current driver 10 and the surrounding earth causes current driver 10 and the earth to effectively function together as a vertical plane polarized antenna which produces a vertically polarized electromagnetic wave. The current loop is formed as a result of capacitive coupling which occurs between the conducting arms 16 and 18 of current driver 10 and the surrounding earth. For good performance the capacitive reactance must be small with respect to the current driver resistance.

The current loop action is illustrated by reference to the ground current loop paths 15 and 23 of FIGS. 6 and 7. Current loop paths 15 represent vertical paths, while current loop paths 23 represent current paths to the sides of current driver 10. In the embodiment of FIG. 8 the electrical current from the transmitter/receiver 13 passes by way of coaxial cable 14 to one of the conducting arms 16 or 18 of current driver 10, as for example conducting arm 16 which is connected to conductor 22 of the coaxial cable 14. The current is capacitively coupled to the surrounding earth through which it travels along current loop paths 15 and 23 to the other conducting arm 18. The current is then capacitively coupled to conducting arm 18, from which it returns to the generator of transmitter/receiver 13 by way of conductor 20 (see FIG. 8).

As shown by the current loop paths 15 and 23 in FIGS. 6 and 7, electrical currents flow on all sides of current driver 10. However, the electromagnetic waves from current loop paths 23 (see FIG. 7) cancel each other so that no resultant signal is produced since the current loop paths on one side of current driver 10 are opposite in direction to the current loop paths on the other side of current driver 10, as schematically shown by the directional arrows. As is also schematically illustrated by the directional arrows on the ground current loop paths 15 (see FIG. 6), the top and bottom loops are also opposite their respective directions. However, as shown in FIG. 6, when current driver 10 is positioned near the ground surface 11 the area which defines the path of the upper ground currents becomes smaller. Thus, the upper ground currents do not significantly cancel the electromagnetic waves resulting from the bottom or lower ground currents. Thus, the lower ground currents act together with conductive arms 16 and 18 to define a vertical plane loop which produces vertically polarized electromagnetic signals.

The electromagnetic waves emitted from the communication system are subject to slightly reduced gain as a result of the cancellation effects of the upper loop with respect to the larger lower loop of vertical paths 15. However, as the current driver 10 is positioned closer to the surface 11 of the ground, the upper loop grows smaller and thus less signal degradation is apparent The design criteria for determining optimum current driver depth is explained more fully below.

FIG. 9 illustrates a typical signal wave pattern of the end-fed current driver 10. The azimuth wave pattern for this and all bidirectional single current driver embodiments of the present invention is a figure eight pattern with lobes 40 in line with the axis of current driver 10 and with a deep null 41 normal to the axis of current driver 10 which is just the opposite of a dipole in air. The 3 dB beam width of this pattern is about 90 degrees and thus one such bidirectional current driver configuration produces a signal wave which covers two 90 degree sectors for a total coverage of 180 degrees. The elevation pattern (not shown) is that of a typical vertical loop antenna. Typically, in a single current drive embodiment, the signal wave radiation along the suface of the earth is less by about 3 dB than at the peak of the pattern, with this value being variable with signal frequency and with the conductivity and dielectric constant of the earth. The radiated polarization near the earth's surface is vertical, as is necessary for efficient ground wave propagation.

3. The Center-Fed Current Driver (FIGS. 10 through 12)

Another preferred embodiment of the present invention employs a single, center-fed current driver 50, as illustrated in FIGS. 10 through 12. With reference to FIG. 10, current driver 50 includes two conducting arms 16 and 18 which are the same in their construction as the conducting arms 16 and 18 of current driver 10 described above. However, unlike current driver 10, the conducting arms 16 and 18 of current driver 50 are not joined at the middle by a dielectric partition, and are instead connected at their adjacent to the balun 17. As in the previously described embodiment, balun 17 is connected by the coaxial cable 14 to a transmitter/-receiver 13.

It has been found that the underground communication system of this invention functions properly at current drive/earth combination impedances which correspond to those current loop perimeters which are greater than one wavelength in size at the operating frequency. System performance approaches a peak when the current loop perimeter is approximately 1.5 wavelengths in size, while other peak performance regions are found at each additional full wavelength increase from this value (i.e. at wavelengths of 2.5, 3.5, 4.5, et. seq.). The long-wire guided wave action of the current driver conductors 16 and 18 further improve performance when the loop path length exceeds about 2.5 wavelengths. By using balun 17 to match the impedance of the current driver, and earth to the impedance of the transmitter/receiver 13 and coaxial cable 14, a maximum power transfer may be realized.

The bandwidth operation of the communication system of this invention becomes fairly large when using a transmission line transformer balun. Bandwidths of as much as three octaves have been demonstrated. An example is a 3 to 30 MHz system for HF operation.

Other well known, commercially available impedance matching circuits may also be used for accomplishing the desired impedance matching, although some may tend to have reduced bandwith.

As in the case of the previously described end-fed current driver, the current driver 50 and the surrounding earth effectively function as a vertical plane polarized antenna which produces a vertically polarized electromagnetic wave. The loop action is illustrated best by reference to the ground current loop paths 15 and 23 (see FIGS. 10 and 11). The electrical current from the generator of transmitter/receiver 13 is conducted through coaxial cable 14 to balun 17 and from balun 17 through conductor 22 to the conducting arm 16. Conducting arm 16 is capacitively coupled to the surrounding earth so that ground currents will flow on all sides of the current driver 50 to the opposite conducting arm 18, which is also capacitively coupled to the earth so that it picks up the current. From conducting arm 18 the current is returned through the balun 17 and through cable 14 to the generator of transmitter/-receiver 13.

As in the case of the previously described embodiment, the electromagnetic waves resulting from the side ground currents 23 (see FIG. 11) are cancelled because the ground current loops on each side of the current driver 50 are in opposite directions. The cancellation effects resulting from the vertical ground currents illustrated by paths 15 (see FIG. 10) can be minimized by properly positioning the center-fed current driver 50 at a proper distance from the surface 11 of the ground, as hereinafter more fully described. The result is that the current driver 50 functions with the earth in a vertical plane loop mode and they produce a vertically polarized electromagnetic signal that is essentially identical in its characteristics (see, e.g., FIG. 12) to the vertically polarized electromagnetic signal previously described in connection with FIG. 9.

The center-fed current driver 50 has been found to have one particular advantage over the end-fed current driver 10. Since the coaxial cable 14 for the end-fed current driver 10 is not positioned at the center point of the current driver 10, if the conductors 20 and 22 of cable 14 cross at the end of the current driver 10 a shorting effect may result. This is due to the fact that the fields inside coaxial cable 14 become coupled to the outside of the coaxial cable. By feeding the current driver from its center point, it is much easier to avoid crossing the current driver 50 with the coaxial cable 14.

4. The Center-Fed Current Driver Array (FIGS. 13 through 15)

The efficiency of a system using a single buried current driver may be low due to signal losses in the earth. Efficiency can be improved by using multiple current drivers 50 connected in a configuration such as that illustrated in FIG. 14. To form a current driver array two or more center-fed current drivers 50 are configured so that their conducting arms 16 and 18 are respectively in parallel alignment, both vertically (see FIG. 13) and horizontally (see FIG. 14). In the illustrated embodiment four identical current drivers 50 are shown, although of course the number may vary as a matter of design choice and system requirements. The individual current drivers 50 are fed with power of the same amplitude and phase. This is accomplished by using a conventional power splitter 30 connected to an impedance matching balun 17 for each current driver 50 connected by coaxial cables 14. It is important that the interconnecting coaxial cables 14 between baluns 17 and power splitter 30 be of equal length so that current driver elements 50 are fed with power of the same phase angle.

Each of the individual current drivers 50 in the array function with the earth as a vertical plane polarized antenna in the same manner as the current driver 50 which was previously described in connection with FIGS. 10 through 12. With the current drivers 50 connected and balanced as illustrated in FIG. 14, and with proper parallel spacing between the current drivers 50, the power gain and efficiency of the current driver array becomes a direct multiple of the number of current drivers contained in the array. For example, the power gain and efficiency of an array containing four current drivers is approximately four times the power gain and efficiency of a single center-fed current driver.

The parallel spacing between the current drivers in the array is an important design consideration in achieving improved power gain and efficiency. For wide beam operation the basic requirement is that the entire width of the parallel array be no more than half a wavelength in air at the system's operating frequency. If the current driver array exceeds this dimension, the transmitted signal beam pattern becomes proportionately reduced. On the other hand, the parallel current drivers 50 may not be positioned so close to each other as to experience significant mutual impedance or other coupling effects between the adjacent current drivers.

The size and spacing of an aboveground antenna array are quite different from that of the present invention. For example, at 400 KHz the wavelength in air is 750 meters. Typical required spacing of parallel antennas aboveground would be half a wavelength or 375 meters. Mutual impedance effects would begin occurring at spacings which are only a little less than this.

In contrast, at 400 KHz the wavelength propagated through the ground is in the range of 100 meters or less and thus the half wavelength spacing would be about 50 meters. However, current drivers of the type described herein experience essentially no significant mutual coupling even at parallel spacings as close as approximately a skin depth. Operation with spacings as close as 0.5 skin depths have been tested with satisfactory results. A skin depth is the distance at which an electromagnetic wave would attenuate by $e^{-1}$, where e is the base of the natural logarithm (2.718). For typical low conductivity soils, one skin depth is on the order of 10 meters at high frequencies and 40 meters or more at low frequencies (see, e.g., FIG. 29 for typical values of skin depth). Thus, with the present invention it is possible to produce a communication system with a very high power gain and high signal quality using an underground current driver array which occupies a relatively small area. This is one of the principal advantages of the present invention.

With reference to FIG. 15, it is seen that the signal pattern 40 of the current driver array is virtually the same as that of the single current driver 10 or 50 (see FIGS. 9 and 12, respectively) so long as the overall current driver array width does not exceed half a wavelength in air at the operating frequency of the system. If the array width exceeds this value, then the azimuth beam angle will decrease as in conventional antenna arrays located aboveground.

The current driver array has the additional advantage that its signal pattern 40 (see FIG. 15) may be steered with the use of conventional phase shifters (not shown).

Phase shifting is accomplished by varying the phase relationship of the current drivers using conventional methods known in the communications industry. Since jamming is normally generated from a particular direction, it may be avoided by use of narrow beams and by steering the signal pattern of the array in a direction other than that of the jamming signal source. Thus, the steerable wave pattern of the current driver array makes this arrangement more secure for military purposes than the single current driver embodiment. Since atmospheric noise is often generated from a particular direction, narrow beams and steering also permit the effects of such noise to be greatly reduced by not steering the signal pattern in the direction of the noise.

5. The Center-Fed Current Driver Array With Tree Termination (FIGS. 16 through 18)

Due to the physical effects of the earth in terms of shortening the wavelength of a signal propagated through the ground as opposed to the air (typical reductions range from one-half to one-tenth, depending on frequency, conductivity of the earth, and dielectric constant of the earth), the size of the earth antennas which are formed as described herein is significantly less than the size required for conventional aboveground antennas to operate at similar frequencies and thus as required length of the underground current drivers is very small when compared to those typical aboveground antennas. Even so, the length of the current driver is still rather large at low frequencies.

One important requirement of the system of the present invention is that the coupling reactance between the current driver and the ground must remain small at all frequencies. It has been found that at lower frequencies the current driver capacitance must be increased to keep the reactance as low as needed. Capacitance is a function of the current driver conductor dimensions, the number of conductors in parallel, and the conductive characteristics of the surrounding ground. Thus, as the frequency goes down, it becomes necessary to add size to the current driver or to add parallel conductors in order to increase the capacitance for purposes of keeping the reactance low.

As illustrated in FIGS. 10, 13, and 16, the vertical ground currents 15 are generally transmitted from locations along the outer mid section of conducting arms 16 and 18. Thus, the mean path for capacitive coupling tends to be toward the middle of the conducting arms 16 and 18. As the length of conducting arms 16 and 18 is increased in order to transmit and receive at lower frequencies, capacitive coupling tends to occur further out along the arms 16 and 18. However, the mean path of the capacitive coupling continues to be at approximately the mid point of conducting arms 16 and 18.

Since the true frequency of system operation is determined by the current paths, and since the location of capacitive coupling along the conducting arm identifies the current path, it is the location of capacitive coupling and not entirely the actual current driver length which ultimately defines the operating frequencies for a particular current driver configuration. In light of these considerations, if the location of capacitive coupling can be brought closer to the ends of the conducting arms 16 and 18, then the required length of the actual current driver necessarily will be less.

One way of moving the capacitive coupling closer to the ends of conducting arms 16 and 18 is to use the tree terminations generally designated 32, and shown best in FIG. 17. Tree terminations 32 can be simply constructed using insulated cable or pipe. The terminations 32 are positioned parallel to each other and are attached to the ends of conducting arms 16 and 18. In the alternative, suitable terminations may be constructed using insulated metal plates (not shown) or a single insulated conductor which is attached to the end of conducting arms 16 and 18 and extends coaxially therefrom. Terminations 32 may be used on the ends of a single current driver or they may be used in a current driver array as illustrated in FIG. 17.

The number of separate conductors 33 used in each tree termination 32 and the length thereof is a function of the capacitance of the conductors 33. As more conductors 33 are connected in parallel, the overall length of the tree terminations 32 may be reduced. The actual determination of conductor quantity and termination length is strictly a function of the amount of capacitance necessary to locate the capacitive coupling at a position on conducting arms 16 and 18 which will permit operation of the communication system at the desired frequency.

The spacing of the individual conductors 33 within each tree termination 32 is not critical. In typical underground applications, a spacing of approximately two feet or more between the conductors 33 is adequate.

Without the tree terminations 32, the necessary overall length of the conducting arms 16 and 18 is typically on the order of about one wavelength as measured in the ground medium at the system operating frequency. With tree terminations 32 the optimum overall length of conducting arms 16 and 18 may be on the order of two-thirds to three-quarters wavelengths as measured in the ground medium at the system frequency.

Except for the tree terminations 32 as described above, which have the effect of permitting the overall length of each individual current driver to be shortened somewhat, basic operation of the array illustrated in FIGS. 17 and 18 is the same as the current driver array previously described in connection with FIGS. 13 through 15. That is to say, the array with tree terminations 32 also functions in combination with the earth as a vertical plane polarized antenna array by virtue of capacitive coupling between each individual current driver 50 and the surrounding earth.

With reference to FIG. 18, the signal wave pattern 40 is virtually identical to the signal pattern (see FIG. 15) of the array described in connection with FIGS. 13 and 14.

6. The Wide Band Switched Array (FIG. 19)

Military communication requirements include systems which operate as VLF, LF, MF, HF, and VHF. With the present invention it is possible to operate at any or all of these frequencies in a single system installation. FIG. 19 illustrates one means for accomplishing this type of wide band operating capability using the principles of the present invention.

The embodiment of FIG. 19 includes a control center 70 which contains a transmitter/receiver (not shown) as well as a conventional power splitter (not shown) together with other electronic control circuitry (not shown) for controlling the system operation as hereinafter more fully described. The control center 70 is connected to the various current driver elements generally designated at 72–76 by means of coaxial cable 14.

In the illustrated embodiment, various types of current driver elements 72–76 are used in combination. For example, the current driver elements 72 comprise center-fed current drivers which are similar in their construction and basic operation to the center-fed current driver embodiment previously described in connection with FIGS. 10 through 12. The current drivers 72 each have a pair of conducting arms 78 and 80 which are connected to an impedance matching circuit 17 which may be, for example, a balun. The conducting arms 78 and 80 consist of No. 12 copper wire or other suitable wire, cable or pipe as previously described. The length of each conducting arm 78 and 80 is approximately 300 meters. At this length, current drivers 72 are designed to operate in the frequency range of 40 KHz to 100 KHz.

Current driver 73 is also a center-fed current driver. The current driver 73 includes two identically configured conducting arms generally designated at 82 and 84 which are placed end-to-end and which are connected to a balun 17 for purposes of matching the impedance of the conducting arms 82 and 84 to the impedance of the transmitter/receiver (not shown) located at the control center 70. For purposes of simplifying the illustration and description, only the elements of conducting arm 82 are described in detail and it will be understood that the opposite conducting arm 84 is identically constructed.

Conducting arm 82 consists of four lengths of cable 85–88 which, in the illustrated embodiment, may be, for example, No. 12 copper wire. Each length of cable varies. For example, the length of cable 85 is approximately two meters, cable 86 is approximately two and one-half meters, cable 87 is approximately four and one-half meters and cable 88 is approximately 286.5 meters. The lengths of cable 85–88 are interconnected by a series of switching devices 90–94. Each switching device 90–93 may be, for example, a conventional electrical relay which can be activated from the control center 70 to connect or disconnect the various lengths of cable 85–88.

The switching elements 90–93 may also be conventional pneumatic switches, relays or other suitable types of conventional switching devices. When using electrical relays as switches it is necessary to use RF chokes in the control lines at the current driver switching locations. The pneumatic switches with dielectric control lines avoid the use of RF chokes with resulting increased electromagnetic pulse (EMP) hardness.

The tree termination generally designated 94 is interconnected between the switching elements 92 and 93 and forms part of the conducting arm 82, along with the lengths of cable 85–88.

In use, the various lengths of cable 85–88 together with the tree termination 94 may be combined in various ways through the use of switching elements 90–93 to vary the length of the conducting arms 82 and 84 for purposes of permitting the current driver 73 to be used over a wide band of frequencies. For example, the length of cable 85 is designed for operation in the range of 15 MHz to 30 MHz. By using the switching element 90 to add the length of cable 86 to the length of cable 85, the current driver 73 can be operated in the range of 8 MHz to 15 MHz. Similarly, by using switching element 91 to add the length of cable 87 to the lengths of cables 86 and 85, the current driver can be operated in the range of 3 MHz to 8 MHz. When switching element 92 is operated to add the tree termination 94 to the three lengths of cable 85–87, system operation is in the range of 1.5 MHz to 3 MHz.

Also, it should be noted that other current drivers such as the current drivers 74, 75 and 76 may be designed to include lengths of cable, switching elements and tree terminations which are the same as the cable lengths 85–87, tree termination 94 and switching elements 90–92 of current driver 73, with the net effect of creating a current driver array consisting of essentially eight identical current driver elements, depending on how each current driver element is switched. As previously explained, use of eight current drivers in an array will increase the signal gain by a factor of eight in the particular range of operating frequencies.

By adding the length of cable 88 through the use of switching element 93, the current driver 73 becomes approximately the same in its length as current driver elements.72, and is thus capable of operating as part of a parallel array in the frequency range of 40 KHz to 100 KHz.

Other possible switching arrangements are illustrated in connection with the current driver elements 75 and 76. For example, current driver 75 includes a further tree termination generally designated at 96 which includes five conductors 97, each of which is approximately eighteen meters in length. When the tree termination 96 is switched so as to form a part of the conducting arm of the current driver element 75, the current driver 75 is operational in the frequency range of 350 KHz to 500 KHz. And, as illustrated by current driver element 76, a further extension 98 can be added onto the tree termination 96 to further increase the length of the current driver 76, thus permitting operation at even lower frequency ranges.

From the foregoing illustrative embodiment, it is apparent that the principles of the present invention can be advantageously used to design a highly flexible and efficient underground or surface deployed communication system capable of wide band operation, and in conjunction with enhanced signal processing, capable of performance at data rates closely comparable to conventional aboveground wireless communication systems. The current drivers used in the array can be either end-fed or center-fed members which, when properly matched by the baluns 17 to the impedance of he transmitter/receiver, will effectively operate with the earth as vertical plane polarized antennas. Moreover, by properly combining the various current driver elements of the array, signal gain can be materially enhanced.

7. The Unidirectional Buried Current Driver (FIGS. 20–22)

There are a number of significant advantages to having an underground communication system which includes an earth antenna having the capability of end fire or unidirectional operation. These advantages include (1) reduced effects from noise and interference (jamming) originating from directions other than the desired communication direction; (2) increased transmit signal gain both from each current driver element, and from each array which utilizes this configuration; and (3) reduced production of interference in other communication units not in the desired communication direction. FIG. 20 illustrates one means for accomplishing this type of unidirectional operating capability using the principles of the present invention.

The embodiment of FIG. 20 includes a current driver 200 having conducting arms 226 and 228 positioned in end-to-end alignment and connected at their adjacent ends to a balun 17 which provides impedance matching as well as balance-to-unbalance transformer action. Current driver 200 is positioned beneath the surface of the earth 11 in the manner previously described so as to provide ground currents 208 which are induced through current driver 200 by means of a transmitter/-receiver (not shown).

In the illustrated embodiment, it is seen that conducting arm 226 is substantially shorter than conducting arm 228. In this configuration the communication system functions as a unidirectional antenna. It has been found that this communication system functions best as a unidirectional antenna when the length ratio between conducting arm 228 and conducting arm 226 is 2 to 1 or greater.

It is apparent that the current loop path formed by currents 208 is not centered about the balun 17, but rather the current loop is significantly elongated in the direction of the longer conducting arm 228. Thus, the current loop formed by currents 208 through the earth and through current driver 200 causes the current driver 200 and the earth 11 to function as a traveling wave antenna in which the long conducting arm 228 acts as a "slow-wave structure" which effectively controls the propagation direction of the wave produced by the basic loop antenna.

FIG. 21 illustrates a typical signal wave pattern 230 of the unidirectional current driver arrangement. The azimuth wave pattern for this current driver embodiment comprises an unbalanced figure eight pattern with the main or front beam being in line with the conducting arms of current driver 200, and propagating in the direction of the longer arm 228. The 3 dB beam angle for a single element as illustrated in FIGS. 20 and 21 is 40–60 degrees wide, depending upon frequency. As the communication system operating frequency increases, signal gain is found to increase and beam angle is found to become narrower.

The front-to-back lobe ratio for the unidirectional signal produced by a current driver 200 which has a 2 to 1 conducting arm length ratio as illustrated in FIG. 21 is typically about 10 dB. In this configuration, the signal bandwidth tends to be somewhat wider than the previously described bidirectional signal and thus the unidirectional system experiences a more uniform performance over the 2 to 30 MHz operating range. In addition, in the unidirectional operating configuration the lower cutoff frequency is controlled by the length of the shorter conducting element 226, and it has been found that the transmit signal gain for this configuration is approximately 3 to 10 dB higher than that in the bidirectional configuration, the exact amount depending upon the system operating frequency.

The unidirectional current driver configuration may be utilized in array form as illustrated in FIG. 22. The configuration of the array of FIG. 22 is substantially identical to the center-fed loop array illustrated in FIGS. 13 through 15, with the exception that the length ratio of the conducting arms is modified as explained above. As with the bidirectional current driver array, the current drivers in the array (four in this example illustration) are fed with power of the same amplitude and phase. This is accomplished by using a conventional power splitter 30 connected by coaxial cables 14 to a 4-to-1 balun 17 for each current driver 200. It is important that the interconnecting coaxial cables 14 between baluns 17 and power splitter 30 be of equal length so that the current drivers 200 are fed with the same phase angle.

The operating parameters for a unidirectional current driver array are substantially identical with those previously discussed with respect to the bidirectional current driver array configuration. Thus, for wide beam operation the basic requirement is that the entire width of the parallel array be no more than half a wavelength in air at the system's operating frequency.

Likewise, the degree of improvement in system performance of a unidirectional current driver array as compared with a single unidirectional current driver system is substantially identical to the improvement in performance experienced in the bidirectional current driver situation. Thus, with the current drivers 200 connected and balanced as illustrated in FIG. 22, and with proper parallel spacing between the current drivers 200, the power gain and efficiency of the current driver array becomes a direct multiple of the number of current drivers contained in the array.

Still further, as is the case in the bidirectional current driver situation, the signal pattern 234 of the unidirectional current driver array is virtually the same as the waveform 230 (FIG. 21) of the single unidirectional current driver, so long as the overall current driver array width does not exceed half a wavelength in air at the operating frequency of the system. The unidirectional current driver array of FIG. 22 also provides the advantage of steerability through the use of conventional phase shifters.

Because of its greatly improved gain as compared to that of the bidirectional current driver arrangement, coupled with the further flexibility provided in the steerable current driver array arrangement, the unidirectional current driver configuration becomes particularly desirable in applications requiring strong, steerable directional signals, or in applications requiring the ability to minimize the effects of interference either from other sources, or as produced by the current driver communication system itself.

8. The Cancellation Current Barrier (FIGS. 23 through 26)

By reference to FIGS. 6 and 7, it is possible to identify several additional factors which reduce the operating efficiency of the underground communication system disclosed herein. In particular, it can be seen that even though the current driver is positioned in proximity to the surface of the earth, some vertical plane loop currents still exist between the current driver 10 and the surface of the earth 11. These currents travel in directions opposite to the loop currents beneath the current driver 10, and thus they cancel the effect of some of the currents below the current driver, thus reducing the system performance. This problem becomes especially true during wet weather conditions when increased conductivity in the earth above current driver 10 permits increased current flow in that region. Thus, one further improvement to the communication system of the present invention would be to prevent the flow of loop currents in the ground above current driver 10.

By reference to FIG. 7 it is apparent that the currents on each side of current driver 10 effectively cancel each other out. Nevertheless, the energy utilized to produce these cancellation currents is simply wasted, comprising another source of communication system inefficency. Therefore, it would be another important improvement to the communication system to provide a means for preventing the flow of the side currents 23 as illustrated in FIG. 7.

Upon examination of FIGS. 6 and 7 it becomes readily apparent that one method of eliminating cancellation currents above the current drive 10 is to position the current driver near the surface of the earth. As the depth of earth above current driver 10 increases, so does the volume of cancellation currents flowing above that member. Thus, selection of the amount of earth over current driver 10 can be used as a mechanism for inhibiting the cancellation currents which may otherwise result.

In addition to the problems with cancellation currents as described above, current driver operation typically creates induced ground currents near the center of the current driver. These induced ground currents act to effectively short out the current driver, and their effect is especially apparent at high frequencies such as those in excess of 20 MHz, because of the low per unit length capacitive reactance of the current driver at these frequencies. As a result, it would be a further improvement in the communication system to provide a means for removing these unwanted center ground currents.

One preferred embodiment of a means for overcoming the cancellation current problem described above is illustrated in FIGS. 23 and 24. By reference to FIG. 23 it is seen that a layer of low conductivity material 138 is placed over the current driver 100 so as to extend between the current driver and the surface of the earth 11 along substantially the entire length of the current driver 100. Layer 138 can be comprised of any low conductivity material such as rocks or asphalt. By this inhibiting means, ground loop currents are substantially prevented from forming in the region between the top of current driver 100 and the surface of the earth 11. Alternatively, the layer 138 can comprise material such as rocks positioned directly above the current driver 100, with asphalt or some other water resistant material being placed adjacent the surface of the earth. The asphalt or water resistant material in this configuration serves to keep the region above the current driver dry and low in conductivity in all seasons and weather conditions.

Another layer of porous low conductivity material 140 is positioned directly beneath the center portion of current driver 100, so as to prevent or greatly reduce the formation of induced ground currents near the center of the current driver. Connected to the lower portion of the porous material 140 is a drain 142. The drain 142 is provided so as to preclude collection of water in the areas containing material 140, thus preventing formation of higher conducting paths through such water.

By reference to FIG. 24, it is seen that the low conductivity covering 138 may be positioned so as to extend outwardly from current driver 10 in the region around the central portion of the current driver. By positioning the low conductivity material 138 in this manner, side cancellation currents are substantially eliminated.

Another preferred embodiment of the cancellation current barrier is illustrated by reference to FIG. 25. In this embodiment a single trench of substantially uniform depth may be formed, with an initial layer of low conductivity material 144 placed in the bottom thereof along approximately the center two-thirds of the trench's length. A current driver 100 comprised of insulated wire, or similar conductive material having reasonable flexibility, is placed within the trench so that its center portion is positioned upon the low conductivity material 144. The end portions of current driver 100 are placed directly upon the earth. An additional layer of low conductivity material 146 is then placed over current driver 100. Optionally, an asphalt or other low conductivity, water resistant covering may comprise low conductivity material 146, or the water resistant material may optionally be extended over the low conductivity material 146 near the top of the trench. Drainage for this embodiment is provided by means of a nonconducting pipe 148 or similar conventional drainage means extending downward and away from a drain inlet position in the lower portion of the trench and adjacent low conductivity material 144.

Still another preferred embodiment for the cancellation current barrier of the present invention is illustrated in FIG. 26. The configuration of FIG. 26 comprises a small mound within which is positioned a double level trench. The lower level of the trench is filled with porous, low conductivity material 152 such as rock. A drain 154 positioned in the lower portion of the lower trench is comprised of a low conductivity pipe which provides a means for draining water away from the lower portions of the trench. A current driver 100 is positioned within the trench so that the outer portions of the current driver's extended conducting arms 102 and 104 are positioned on the earth 11, while the central portion of current driver 100 is positioned adjacent to the low conductivity material 152. An additional layer of low conductivity material 156 such as porous rock is positioned above the current driver along its entire length. Positioned upon the upper layer of low conductivity material 156 is a layer of asphalt 158 or similar water resistant material. This mound configuration provides a means whereby water contacting the mound surface is drained away without passing downwardly through the porous, low conductivity materials 156 and 152. The drain 154 provides a means whereby any water which may enter the trench area is carried away from the vicinity of the current driver 100.

By reference to FIG. 27, it becomes apparent that the cancellation current barrier arrangement may also be successfully utilized in array current driver applications. Specifically, the configuration of the cancellation current barrier of FIG. 27 may comprise any of the embodiments described above. In addition, the outward extending portions 160 of the low conductivity material 138 are joined together so as to define a continuous extension between adjacent current drivers. By this means, transmission of side cancellation currents is substantially prevented.

Through use of the cancellation current barrier described above, capacitive coupling may be encouraged to occur in preferential coupled regions, and communication system efficiency may be further improved by amounts as much as 4 to 6 dB. In addition, the drainage and water protection features of the cancellation current barrier provide an important means for maintaining uniform system operation in substantially any weather condition, as well as for providing increased system operating life by reducing the exposure of the current driver 100 and associated system elements to the corrosive and otherwise damaging effects of extended contact with water.

9. Design Considerations

The foregoing embodiments illustrate many of the wide variety of ways in which the principles of the present invention can be practiced. Following is a brief summary of the principal design criteria that may be varied to meet the design considerations imposed by a given system.

The first step is to determine the length of the underground current driver. Current driver length is inversely proportional to the system's signal frequency. As described above, depending upon whether tree terminations are utilized on the current driver ends, total current driver length will range from three-quarters to one signal wavelength as measured in the ground medium at the desired frequency. Signal wavelength in a ground medium is graphically illustrated as a function of signal frequency in FIG. 28. Graph line 34 represents the wavelength in meters as a function of frequency in rich agricultural earth having a conductivity of $10^{-2}$ mho per meter. Graph line 36 indicates the wavelength in meters as a function of frequency in rocky land having a conductivity of $2\times10^{-3}$ mho per meter. The area 38 between lines 34 and 36 describes the signal wavelength as a function of signal frequency in the majority of typical kinds of ground media. The equation for determining the wavelength represented by lines 34 and 36 of FIG. 28 is $$\lambda = \frac{\kappa}{f\sqrt{\frac{\mu\epsilon}{2}}\left(\sqrt{1+\left(\frac{\sigma}{\omega\epsilon}\right)^2}+1\right)} \quad (1)$$

where $\lambda$=wavelength in the earth (meters)

$\kappa$=1 for large depth and $\sqrt{2}$ for current driver at or above the surface $\mu$=permeability of the earth ($4\pi\times10^{-7}$ weber/amp-meter)

$\epsilon=\epsilon_0\epsilon_r$=permittivity of earth (farad/meter)

$\epsilon_0$=permittivity of free space ($8.85\times10^{-12}$ farad/meter)

$\epsilon_r$=relative permittivity of earth (farad/meter)

$\sigma$=conductivity of earth (mho/meter)

$\omega=2\pi f$ f=frequency (Hz).

In the case of a communication system operating at a frequency of 400 KHz, from equation (1) the signal wavelength is equal to approximately 100 meters when propagated through low conductivity ground at that frequency. Thus, total current driver length will range from 75 to 100 meters, depending on whether tree terminations are used at the ends of the current driver.

Another principal consideration in the design of the present invention is the depth of current driver burial. As previously indicated, there is approximately a 3 dB drop in power gain when the current driver is buried approximately one meter below the earth's surface as compared to deployment on the ground surface. This loss is principally due to the electromagnetic field cancellation effects of the vertical ground current paths 15 (see FIG. 1), as previously mentioned. Although reduction in power gain continues to increase as the current driver is buried deeper, the rate of reduction is much less significant than the initial reduction experienced as between surface deployment and burial just beneath the earth's surface.

Penetration or skin depth is graphically illustrated as a function of signal frequency in FIG. 29. Graph line 48 represents the penetration depth in meters as a function of frequency in rich agricultural earth having a conductivity of $10^{-2}$ mho per meter. Graph line 49 indicates the penetration depth in rocky land having a conductivity of $2\times10^{-3}$ mho per meter. The area 47 between lines 48 and 49 describes the penetration depth in the majority of typical kinds of ground media. The equation for determining the penetration depth represented by lines 48 and 49 of FIG. 29 is $$\delta = \frac{1}{\omega\sqrt{\frac{\mu\epsilon}{2}}\left(\sqrt{1+\frac{\sigma^2}{\omega^2\epsilon^2}}-1\right)} \quad (2)$$

where $\delta$=is the penetration depth (meters)

$\omega=2\pi f$ $\mu$=the relative permeability of the surrounding earth (weber/amp-meter)

$\sigma$=the conductivity of the surrounding earth (mho/meter)

$\epsilon$=the dielectric constant of the surrounding earth.

It is well-known that for low frequencies in the range of 50 to 150 KHz, equation (2) may be simplified to $$\delta = \frac{1}{\sqrt{\pi f\mu\sigma}} = \frac{503.3}{\sqrt{f\sigma}} \quad (3)$$

Thus, using as an example a system operating at 150 KHz, and assuming the conductivity of the surrounding earth to be $10^{-3}$ mho per meter, from equation (3) the penetration depth would be about 41 meters. It has been determined that the maximum effective current loop depth is on the order of one skin depth.

10. Summary

The current driver configurations embodied in the present invention offer the following advantages, among others: (1) the underground positioning of the current driver provides system hardness and survivability in all cases except a direct hit by a nuclear weapon, while permitting data transmission on a wide frequency band and, when using enhanced signal processing, at data rates comparable to conventional aboveground systems; (2) because of its underground positioning and the use of capacitive coupling with the earth to produce a vertical plane polarized antenna configuration, the communication system of the present invention permits communication at frequencies ranging from the VLF range to the VHF range; (3) by placing the current drivers underground and by using two or more current drivers in a parallel array configuration, significant improvement in signal power gain and communication system operating efficiency are achieved, while requiring only a relatively small underground area for the placement of the current driver array; (4) by use of the tree terminations, coupling is improved and the mean location of capacitive coupling between the current driver and the earth is extended toward the outer ends of conducting arms, with the result that the required current driver length for operation at a given frequency is significantly reduced; (5) because of increased bandwidth and directional steering the system has potential for very low vulnerability to jamming and other adverse effects of interfering electromagnetic radiation; (6) by configuring the current driver such that one end is shorter than the other, a unidirectional vertical plane polarized antenna can easily and quickly be formed, having improved signal gain and narrowed beam width for further improvement in the ability to avoid signal interference; (7) a means is provided whereby the undesirable effects of cancellation currents can be minimized and the current driver can be protected for all weather high quality operation; (8) the communication system described herein is also adaptable for use in a surface deployment mode upon the surface of the ground, in near surface, aboveground deployment, or in a shallow trench so that the system may be easily transported; (9) camouflage of the system is a simple matter, and decoying through use of dummy current drivers is also economically feasible; (10) environmental impacts are minimized and surrounding aesthetic conditions are preserved; and (11) overall costs are significantly reduced, permitting redundancy of installation to further increase system hardness.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A wireless communication system including a transmitter/receiver for generating and processing electromagnetic signals, the system comprising:

current driver means comprising at least two conductors positioned in proximity to the earth's surface, said conductors each comprising means for encouraging capacitive coupling of said conductors to the earth along a first portion of the length of said conductors such that a closed current loop is formed by said conductors in combination with the earth, said conductors of the current driver means having a sufficient overall length so that the closed current loop has a perimeter which is greater than one wavelength of said electromagnetic signals when propagating through the earth, whereby the earth and said current driver means function together as a vertical plane polarized antenna;

means for connecting the transmitter/receiver to the current driver means; and means for inhibiting cancellation currents along a second portion of the length of the conductors.

2. A wireless communication system as defined in claim 1 wherein the current driver means is protected along substantially its entire length by an external sheath of electrical insulating material.

3. A wireless communication system as defined in claim 1 further comprising means connected to the transmitter/receiver and to the current driver means for adjusting the impedance of said current driver means and the earth as measured above one wavelength at the operating frequency so as to correlate said impedance with the impedance of the transmitter/receiver.

4. A wireless communication system as defined in claim 1 wherein the current driver means is deployed substantially parallel to the earth's surface.

5. A wireless communication system as defined in claim 1 wherein the current driver means is configured such that current will be capacitively coupled to the earth in a preferential coupled region.

6. A system as defined in claim 1 wherein the length of one of said conductors is less than the length of the other of said conductors such that the electromagnetic signal transmitted outwardly in the direction of said other conductor has a greater signal gain than the electromagnetic signal transmitted outwardly in the direction of said one conductor.

7. A wireless communication system including a transmitter/receiver for generating and processing electromagnetic signals, the system comprising:

current driver means comprising at least first and second conductors positioned in proximity to the earth's surface, said conductors each comprising means for encouraging substantial capacitive coupling between at least a portion of said conductors and the earth in a preferential coupled region so as to establish a closed current loop formed by said conductors in combination with the earth, said conductors having sufficient overall length so that the closed current loop has a perimeter which is greater than one wavelength of said electromagnetic signals when propagating through the earth, whereby the earth and said current driver means function together as a vertical plane polarized antenna;

means for connecting the transmitter/receiver to the current driver means;

means connected to the current driver means for adjusting the impedance presented to the transmitter/receiver by the current driver means so as to correlate said impedance with the impedance of the transmitter/receiver; and means for connecting the adjusting means to the transmitter/receiver.

8. A wireless communication system as defined in claim 7 wherein the current driver means is protected along substantially its entire length by an external sheath of electrical insulating material.

9. A system as defined in claim 7 wherein the conductors are positioned upon the earth's surface along at least a portion of their length.

10. A wireless communication system as defined in claim 7 wherein the current driver means is configured such that current will be capacitively coupled to the earth in a preferential coupled region.

11. A system as defined in claim 7 wherein the current driver means further comprises conductive tree terminations attached to the end of at least one of the conductors, said tree terminations being protected about substantially their entire outer surface by an external sheath of electrical insulating material.

12. A system as defined in claim 7 wherein each of the conductors are divided into one or more lengths and wherein the current driver further comprises switching means selectively connecting the various lengths of each said conductor such that the overall length of each said conductor can be varied for purposes of system operation at various frequencies and for purposes of controlling signal gain, propagation direction and waveshape corresponding to the different possible current driver lengths.

13. A system as defined in claim 7 further comprising a plurality of current driver means which are spaced in parallel to form a current driver array, said parallel spacing between current drivers being at least half a skin depth measured in the earth at the system operating frequency.

14. A system as defined in claim 13 wherein at least one of the conductors in at least one of the current driver means in the array is divided into a plurality of lengths, with switching means selectively connected to the various lengths of each said divided conductor to the various lengths of each said divided conductor in order to vary the overall length of each divided conductor so as to provide for system operation at any one of a plurality of different frequency ranges, and for purposes of controlling signal gain, propagation direction and waveshape corresponding to the different possible current driver lengths.

15. A system as defined in claim 13 further comprising: a power splitter interconnected between said transmitter/receiver and each said current driver in the array, the power splitter being connected to each of the current drivers in the array through substantially equal lengths of coaxial cable, and the power splitter providing power of the same amplitude and phase to each of the said current drivers.

16. A system as defined in claim 13 wherein the overall width of the current driver array is as much as half a signal wavelength in air at the system's operating frequency without experiencing substantial signal beam compression.

17. A system as defined in claim 13 wherein one or more of the said current drivers comprise conductive tree terminations attached to the ends thereof.

18. A system as defined in claim 7 wherein the first and second conductors are positioned in end-to-end configuration, the current driver means further comprising:

a dielectric partition connected between the adjacent ends of said first and second conductors; and a coaxial cable having first and second conductors connected at one end to the adjusting means, the first conductor being connected through said dielectric partition to one of said conductors, and the second conductor being connected to the other said conductor.

19. A system as defined in claim 7 wherein the first and second conductors are positioned in end-to-end configuration and wherein the adjusting means is positioned between the adjacent ends of said first and second conductors.

20. A system as defined in claim 18 or 19 wherein said conductors are constructed from pipe.

21. A system as defined in claim 18 or 19 wherein said conductors are made from wire cables.

22. A system as defined in claim 18 or 19 wherein the length of one of said conductors is less than the length of the other of said conductors such that the electromagnetic signal transmitted outwardly in the direction of said other conductor has a greater signal gain than the electromagnetic signal transmitted outwardly in the direction of said one conductor.

23. A system as defined in claim 7 wherein said adjusting means comprises a balun.

24. A system as defined in claim 7 further comprising means for inhibiting cancellation currents, said means for inhibiting cancellation currents comprising low conductivity materials positioned so as to lie at least partially in the flow paths of said cancellation currents to inhibit flow of said cancellation currents therethrough.

25. A system as defined in claim 24 further comprising means connected adjacent the low conductivity materials for preventing collection of water in areas adjacent to the current driver.

26. A system as defined in claim 7 wherein the current driver means is buried beneath the surface of the earth at a depth of no more than one skin depth measured in the earth at the system operating frequency.

27. A wireless communication system including a transmitter/receiver for generating and processing electromagnetic signals, the system comprising:

a current driver comprising first and second conductors placed end-to-end and in substantially axial alignment, said conductors being coated on substantially their entire exterior surface by a sheath of electrical insulating material and said conductors being deployed substantially parallel to, and in proximity to, the surface of the earth along at least a first portion of their length, said insulated sheath encouraging capacitive coupling between said first portion and the earth so as to establish a closed current loop through said first portion and the earth, said conductors having a sufficient overall length so that the closed current loop has a perimeter which is greater than one wavelength of said electromagnetic signals when propagating through the earth, whereby the earth and said current driver function as a vertical plane polarized antenna;

means for connecting the transmitter/receiver to the current driver;

means for inhibiting cancellation currents along at least a second portion of each of said conductors, said means for inhibiting cancellation currents comprising means for reducing capacitive coupling between said second portion of the conductors and the earth;

a balun connected to the current driver for adjusting the impedance presented to the transmitter/receiver by the current driver so as to correlate said impedance with the impedance of said transmitter/receiver; and a coaxial cable interconnecting the balun to the transmitter/receiver.

28. A system as defined in claim 27 wherein the current driver is buried beneath the surface of the earth at a depth of no more than one skin depth measured in the earth at the system operating frequency.

29. A system as defined in claim 27 wherein the current driver further comprises conductive tree terminations attached to the end of at least one of the conductors so as to provide for system operation at lower frequencies, said tree terminations being protected along substantially their entire length by an external sheath of electrical insulating material.

30. A system as defined in claim 27 wherein the length of one of the conductors is less than the length of the other of said conductors such that the electromagnetic signal transmitted outwardly in the direction of said other conductor has a greater signal gain than the electromagnetic signal transmitted outwardly in the direction of said one conductor.

31. A system as defined in claim 29 or 30 wherein the current driver is buried beneath the surface of the earth at a depth of no more than one skin depth measured in the earth at the system operating frequency.

32. A system as defined in claim 27 wherein the inhibiting means comprises low conductivity material positioned to lie at least partially in flow paths of said cancellation currents and to inhibit flow of said cancellation currents therethrough.

33. A system as defined in claim 32 further comprising means connected adjacent the low conductivity materials for preventing collection of water in areas adjacent to the current driver.

34. A system as defined in claim 27 further comprising one or more current drivers spaced one from the other in parallel to form a current driver array.

35. A system as defined in claim 34 further comprising a power splitter interconnected between each current driver in the array and said transmitter/receiver, the power splitter being connected to each balun in the array through substantially equal lengths of coaxial cable, and the power splitter providing power of equal magnitude and phase to each of said baluns in the array.

36. A system as defined in claim 49 wherein the overall width of the said array is as much as half the signal wavelength in air at the system's operating frequency without experiencing substantial signal beam compression.

37. A method of sending and receiving electromagnetic signals using a wireless communication system comprising a transmitter/receiver for generating and processing electromagnetic signals and a current driver means comprising at least two conductors connected to said transmitter/receiver, wherein the method comprises the steps of:

positioning the conductors in proximity to the surface of the earth;

inhibiting capacitive coupling along at least a first portion of the length of the conductors so as to reduce cancellation currents;

capacitively coupling at least a second portion of said conductors to the earth so that said capacitive coupling between said second portion and earth is encouraged and is substantially greater than the capacitive coupling between said first portion and earth, whereby said conductors and earth together provide a closed current loop; and selecting the length of the conductors to establish a closed current loop having a perimeter which is greater than one wavelength of the electromagnetic signals when propagating through the earth, whereby said current driver means and the earth function as a vertical plane polarized antenna.

38. A method as defined in claim 37 wherein the capacitively coupling step comprises capacitively coupling the conductors to the earth in a preferential coupled region.

39. A method as defined in claim 37 wherein the inhibiting step comprises the step of positioning low conductivity material so as to lie at least partially in flow paths of the cancellation currents and to inhibit flow of cancellation currents therethrough.

40. A method as defined in claim 39 further comprising the step of removing water from the proximity of the current driver so as to prevent prolonged contact between said current driver and said water.

41. A method as defined in claim 37 wherein the communication system includes a plurality of current drivers and wherein the method further comprises the step of placing the current drivers parallel one to the other and as close as half a skin depth between adjacent current drivers, thus forming an array of current drivers having an overall width of as much as one-half the signal wavelength in air at the system's operating frequency without experiencing substantial signal beam compression.

42. A method as defiend in claim 41 further comprising the step of providing each current driver of said array with power that is substantially equal in phase and magnitude.

43. A method as defined in claim 37 further comprising the steps of:

dividing at least one of the conductors of the current driver into a plurality of lengths; and selectively interconnecting one or more of the various lengths of the conductors to provide the current driver with the capability of being used at various frequencies and of producing various signal types and waveshapes depending upon the number of lengths connected together.

44. A method as defined in claim 37 further comprising the step of steering the signals produced by the vertical plane polarized antennas.

45. A method as defined in claim 37 further comprising the step of burying the current driver beneath the surface of the earth at a depth of less than one skin depth.

46. A method as defined in claim 37 further comprising the step of configuring the current driver such that the length of one of its extended conductors is less than the length of its other extended conductor, whereby the electromagnetic signal transmitted outwardly in the direction of said other conductor has a greater gain than the electromagnetic signal transmitted outwardly in the direction of said one conductor.

47. A method as defined in claim 37 further comprising the step of applying a sheath of electrical insulating material along substantially the entire exterior portion of each of the conductors.

48. A method as defined in claim 36 further comprising the step of applying a sheath of electrical insulating material along substantially the entire exterior portion of each of the conductors.

49. A method as defined in claim 37 further comprising the step of orienting the current driver means so as to be substantially parallel with the surface of the earth.

50. A method of sending and receiving electromagnetic signals using a wireless communication system comprising a transmitter/receiver for generating and processing electromagnetic signals, a current driver means comprising at least two conductors connected to said transmitter/receiver and means connected to the transmitter/receiver and to the conductor for adjusting the impedance of the conductors, wherein the method comprises the steps of:

positioning the conductors in proximity to the surface of the earth along at least a portion of their length;

adjusting the impedance presented to the transmitter/receiver by the current driver means at the operating frequency to correlate the impedance of the current driver means with the impedance of the transmitter/receiver;

capacitively coupling said conductors to the earth in a preferential coupled region of each conductor's length so as to provide a closed current loop; and selecting the length of the conductors to establish a closed current loop having a perimeter which is greater than one wavelength of the electromagnetic signals when propagating through the earth, whereby said current driver means and the earth function as a vertical plane polarized antenna.

51. A method as defined in claim 50 further comprising the step of inhibiting electrical coupling along portions of the length of the conductors so as to reduce cancellation currents.

52. A method as defined in claim 51 wherein the inhibiting step comprises the step of positioning low conductivity material so as to lie at least partially in flow paths of the cancellation currents and to inhibit flow of cancellation currents therethrough.

53. A method as defined in claim 52 comprising the step of removing water from the proximity of the current driver so as to prevent prolonged contact between said current driver and said water.

54. A method as defined in claim 50 wherein the capacitively coupling step comprises capacitively coupling the conductors to the earth in a preferential coupled region.

55. A method as defined in claim 50 wherein the communication system includes a plurality of current drivers and wherein the method further comprises the step of placing the current drivers parallel one to the other and as close as half a skin depth between adjacent current drivers, thus forming an array of current drivers having an overall width of as much as one-half the signal wavelength in air at the system's operating frequency without experiencing substantial signal beam compression.

56. A method as defined in claim 55 further comprising the step of providing each current driver of said array with power that is substantially equal in phase and magnitude.

57. A method as defined in claim 50 further comprising the steps of:

dividing at least one of the conductors of the current driver into a plurality of lengths; and selectively interconnecting one or more of the various lengths of the conductors to provide the current driver with the capability of being used at various frequencies and of producing various signal types and waveshapes depending upon the number of lengths connected together.

58. A method as defined in claim 50 further comprising the step of steering the signals produced by the vertical plane polarized antennas.

59. A method as defined in claim 50 further comprising the step of configuring the current driver such that the length of one of its extended conductors is less than the length of its other extended conductor, whereby the electromagnetic signal transmitted outwardly in the direction of said other conductor has a greater gain than the electromagnetic signal transmitted outwardly in the direction of said one conductor.

60. A method as described in claim 50 further comprising the step of positioning the conductors upon the surface of the earth along at least a portion of their length.

61. A method of sending and receiving electromagnetic signals using a wireless communication system comprising a transmitter/receiver for generating and processing electromagnetic signals, and a current driver comprising first and second conductors connected to said transmitter/receiver, wherein the method comprises the steps of:

positioning the conductors so as to be substantially parallel to, and in proximity to, the earth's surface along at least a portion of their length;

capacitively coupling each of the conductors to the earth along at least a portion of the conductor's length;

interconnecting an adjusting means to the conductors and through a first coaxial cable to the transmitter/receiver;

adjusting the impedance of the current driver means and the earth as measured above one wavelength at the operating frequency to correlate said impedance with the impedance of the transmitter/-receiver;

inhibiting electrical coupling along portions of the length of the conductors so as to eliminate cancellation currents; and inducing an electrical current into the earth through at least a portion of the capacitively coupled portion of the conductors to establish a closed loop current having a perimeter which is greater than one wavelength of the electromagnetic signals when propagating through the earth, such that said current driver and the earth function as a vertical plane polarized antenna.

62. A method as defined in claim 61 wherein the inhibiting step comprises the step of positioning low conductivity material so as to lie at least partially in flow paths of the cancellation currents and to inhibit flow of cancellation currents therethrough.

63. A method as defined in claim 62 further comprising the step of removing water from the proximity of the current driver so as to prevent prolonged contact between said current driver and said water.

64. A method as defined in claim 61 wherein the communication system includes a plurality of current drivers and wherein the method further comprises the step of placing the current drivers parallel one to the other and as close as half a skin depth between adjacent current drivers, thus forming an array of current drivers having an overall width of as much as one-half the signal wavelength in air at the system's operating frequency without experiencing substantial signal beam compression.

65. A method as defined in claim 64 further comprising the step of providing each current driver of said array with power that is equal in phase and magnitude.

66. A method as defined in claim 61 further comprising the step of burying the current driver beneath the surface of the earth at a depth of less than one skin depth.

67. A method as defined in claim 61 further comprising the steps of:

dividing at least one of the conductors of the current driver into a plurality of lengths; and selectively interconnecting one or more of the various lengths of the conductors to provide the current driver with the capability of being used at various frequencies and of producing various signal types and waveshapes depending upon the number of lengths connected together.

68. A method as defined in claim 61 further comprising the step of configuring the current driver such that the length of one of its extended conductors is less than the length of its other extended conductor, whereby the electromagnetic signal transmitted outwardly in the direction of said other conductor has a greater gain than the electromagnetic signal transmitted outwardly in the direction of said one conductor.

69. A wireless communication system including a transmitter/receiver for generating and processing electromagnetic signals, the system comprising:

current driver means having at least a first conductor and a second conductor, each of said conductors being divided into one or more lengths, said conductors being deployed in proximity to the earth's surface along at least a portion of their length;

switching means for selectively connecting the various lengths of said conductors such that the overall length of said conductors can be varied for the purpose of system operation at various frequencies and for purposes of controlling signal gain, propagation direction and waveshape;

means for connecting the transmitter/receiver to the current driver;

means for inhibiting capacitive coupling between said current driver means and the earth along at least a first portion of said conductor so as to reduce cancellation currents;

means connected to the current driver means for adjusting the impedance presented to the transmitter/receiver by the current driver means so as to correlate said impedance with the impedance of the transmitter/receiver;

means for connecting the adjusting means to the transmitter/receiver; and said conductors each comprising means for capacitively coupling said conductors to the earth along at least a second portion of their length such that capacitive coupling along said second portion is substantially greater than the capacitive coupling along said first portion, whereby said current driver means in combination with said earth provides a closed current loop, said conductors of the current driver means having a sufficient overall length so that the closed current loop has a perimeter which is greater than one wavelength of said electromagnetic signals when propagated through the earth, whereby the earth and said current driver means function together as a vertical plane polarized antenna.

70. A wireless communication system including a transmitter/receiver for generating and processing electromagnetic signals, the system comprising:

current driver means having at least two conductors positioned in proximity to the earth's surface along at least a portion of their length, said current drivers comprising conductive tree terminations attached to the ends thereof;

means for inhibiting cancellation currents;

means for connecting the transmitter/receiver to the current driver means;

means connected to the current driver means for adjusting the impedance presented to the transmitter/receiver by the current driver means so as to correlate said impedance of the current driver means with the impedance of the transmitter/receiver;

means for connecting the adjusting means to the transmitter/receiver; and said conductors each comprising means for encouraging capacitive coupling between the earth and said conductors along at least a portion of their length so as to provide in combination with the earth a closed current loop, said conductors of the current driver means having a sufficient overall length so that the closed current loop has a perimeter which is greater than one wavelength of said electromagnetic signals when propagated through the earth, whereby the earth and said current driver means function together as a vertical plane polarized antenna.

71. A method of sending and receiving electromagnetic signals using a wireless communication system comprising a transmitter/receiver for generating and processing electromagnetic signals and a current driver means comprising at least two conductors connected to said transmitter/receiver, wherein the method comprises the steps of:

positioning the conductors in proximity to the surface of the earth along at least a portion of their length;

dividing at least one of the conductors of the current driver into a plurality of lengths;

capacitively coupling said conductors to the earth along a first portion of their length so that said conductors and earth together provide a closed current loop having a perimeter which is greater than one wavelength of the electromagnetic signals when propagated through the earth, whereby said current driver means and the earth function together as a vertical plane polarized antenna;

inhibiting capacitive coupling along a second portion of the lengths of the conductors so as to reduce cancellation currents in the region of said second portion; and selectively interconnecting one or more of the various lengths of said conductors to provide the current driver with the capability of being used at various signal frequencies and of producing various signal types and waveshapes depending upon the number of lengths connected together.

* * * * *